US010072549B2

(12) United States Patent
Inaguma et al.

(10) Patent No.: US 10,072,549 B2
(45) Date of Patent: Sep. 11, 2018

(54) METAL SUBSTRATE FOR CATALYTIC CONVERTERS

(71) Applicant: NIPPON STEEL & SUMIKIN MATERIALS CO., LTD., Tokyo (JP)

(72) Inventors: Tooru Inaguma, Tokyo (JP); Shogo Konya, Tokyo (JP); Yasuhiro Tsumura, Tokyo (JP); Toshio Iwasaki, Tokyo (JP)

(73) Assignee: NIPPON STEEL & SUMIKIN MATERIALS CO., LTD., Tokyo (JP)

( * ) Notice: Subject to any disclaimer, the term of this patent is extended or adjusted under 35 U.S.C. 154(b) by 137 days.

(21) Appl. No.: 15/113,230

(22) PCT Filed: Dec. 24, 2014

(86) PCT No.: PCT/JP2014/006440
§ 371 (c)(1),
(2) Date: Jul. 21, 2016

(87) PCT Pub. No.: WO2015/121910
PCT Pub. Date: Aug. 20, 2015

(65) Prior Publication Data

US 2017/0002711 A1 Jan. 5, 2017

(30) Foreign Application Priority Data

Feb. 12, 2014 (JP) ..... 2014-024743

(51) Int. Cl.
*F01N 3/28* (2006.01)

(52) U.S. Cl.
CPC ..... *F01N 3/2821* (2013.01); *F01N 3/281* (2013.01); *F01N 2330/02* (2013.01); *F01N 2330/32* (2013.01); *F01N 2330/60* (2013.01)

(58) Field of Classification Search
None
See application file for complete search history.

(56) References Cited

U.S. PATENT DOCUMENTS 4,665,051 A * 5/1987 Nonnenmann ..... B01J 35/04 422/180
2003/0073561 A1 4/2003 Utsumi et al.
2012/0247076 A1 10/2012 Horimura et al.

FOREIGN PATENT DOCUMENTS

EP 0 486 276 5/1992
JP 61-115139 7/1986
(Continued)

OTHER PUBLICATIONS

Tsumura et al. JP2011156505A-translated document (Year: 2011).*
(Continued)

*Primary Examiner* — Walter D. Griffin
*Assistant Examiner* — Jelitza M Perez
(74) *Attorney, Agent, or Firm* — Wenderoth, Lind & Ponack, L.L.P.

(57) ABSTRACT

A metal substrate for catalytic converter is characterized by: a flat foil and a corrugated metal foil arranged on a gas inlet side end section being joined to each other; the flat foil and the corrugated metal foil arranged in an outer circumferential joining section being joined to each other, said outer circumferential joining section being connected to an end section of the gas inlet side end section in the axial direction; an outer jacket and the honeycomb core being joined by interposing a bonding layer in the gas outlet side end section area P fulfilling formula (A), when P is the length of the bonding layer in the axial direction; a corrugated metal foil having an impact mitigating section; the impact mitigating section being formed in an area corresponding to at least the gas inlet side end section and the outer circumferential joining section.

$2\ \text{mm} \leq P \leq 50\ \text{mm}$ (A):

18 Claims, 7 Drawing Sheets

(56) References Cited

FOREIGN PATENT DOCUMENTS

| | | | | |
|---|---|---|---|---|
| JP | 63-201631 | | | 12/1988 |
| JP | 2558005 | | | 11/1996 |
| JP | 3199936 | | | 8/2001 |
| JP | 2003-80660 | | | 3/2003 |
| JP | 2006-175346 | | | 7/2006 |
| JP | 2008-264596 | | | 11/2008 |
| JP | 2008264596 | A | * | 11/2008 |
| JP | 4719180 | | | 7/2011 |
| JP | 2011-156505 | | | 8/2011 |
| JP | 2011156505 | A | * | 8/2011 |

OTHER PUBLICATIONS

Matsugami, K. JP2008264596-translated document (Year: 2008).*
Extended European Search Report dated Aug. 1, 2017 in corresponding European Application No. 14882382.6.
International Search Report dated Feb. 17, 2015 in International Application No. PCT/JP2014/006440.
Office Action dated Oct. 4, 2016 in corresponding Japanese patent application No. 2015-562575.
International Preliminaiy Report on Patentability dated Aug. 16, 2016 in International Application No. PCT/JP2014/006440.

* cited by examiner

METAL SUBSTRATE FOR CATALYTIC CONVERTERS

TECHNICAL FIELD

The present invention relates to a metal substrate for catalytic converters that carries catalysts for purifying exhaust gas emitted from automobile internal combustion engines or the like.

BACKGROUND ART

Catalytic metal substrates for purifying exhaust gas carry catalysts in order to purify problematic gas components, such as HC (hydrocarbons), CO (carbon monoxide) and NOx (nitrogen compounds), which impair the human body when emitted in the atmosphere.

A catalytic converter carrying a catalyst is used for purification of exhaust gas in automobiles and motorcycles, and is disposed in an exhaust gas path for the purpose of purification of exhaust gas in internal combustion engines. The metal substrate for catalytic converter is similarly used in a methanol reformer that steam reforms hydrocarbon compounds such as methanol to generate hydrogen-rich gas, a CO remover that reforms CO into $CO_2$ to remove CO, and an $H_2$ combustion apparatus that burns $H_2$ into $H_2O$ to remove $H_2$. Such a catalyst base material is formed by partially joining a honeycomb core and an outer jacket. The honeycomb core is formed by winding a flat metal foil and a corrugated metal foil, and the outer jacket surrounds the outer circumferential surface in the radial direction of the honeycomb core. The honeycomb core includes many exhaust gas channels extending in the axial direction. Exhaust gas can be purified by allowing exhaust gas to flow through this exhaust gas channel from the gas inlet side end surface toward the gas outlet side end surface of the honeycomb core.

Since the metal substrate for catalysts increases in temperature by receiving heat from exhaust gas, the honeycomb core suffers from heat distortion due to foil elongation. In addition, the temperature distribution in the axial direction of the base material for catalysts is not uniform, and the temperature is likely to be higher in the upstream portion than in the downstream portion of the exhaust gas channels. For this reason, heat distortion is larger on the upstream side of the exhaust gas channel. Accordingly, when the honeycomb core and the outer jacket are joined in the portion on this upstream side, a load applied to the joining section between the honeycomb core and the outer jacket increases during a thermal cycle of heating and cooling, possibly causing the honeycomb core to drop off from the outer jacket.

On the other hand, exhaust gas is required to be brought into contact with a wider area of the honeycomb core in order to increase purification performance of the honeycomb core. Furthermore, an increased pressure loss while exhaust gas flows through the honeycomb core leads to decrease in output of a vehicle.

CITATION LIST

Patent Literature

Patent Literature 1: JP 4719180 B
Patent Literature 2: JP 2558005 B
Patent Literature 3: JP 3199936 B

SUMMARY OF INVENTION

Technical Problem

A conceivable method for preventing a honeycomb core from dropping off due to a thermal cycle of heating and cooling includes disposing a joining section only in a position further spaced apart from a gas inlet side end surface of the honeycomb core, that is, only in a gas outlet side end section where temperature variations are smaller. However, since the joining section is forced to be disposed in a limited space of the gas outlet side end section, the dimension in the axial direction of the joining section decreases, thereby reducing joining strength. Therefore, when vibration of a running vehicle is transmitted to the joining section, the honeycomb core may be dropped off from an outer jacket. To address this concern, the invention according to the present application has its first object to provide both durability against cold and heat and durability against impact in a metal substrate for catalytic converter. The invention according to the present application has its second object to improve purification performance. The invention according to the present application has its third object to suppress pressure loss.

Solution to Problem

For achieving the above-described first object, the invention according to the present application provides (1) a metal substrate for catalytic converter including: a honeycomb core containing a flat metal foil and a corrugated metal foil superimposed onto each other and wound around an axis; and a metal outer jacket surrounding an outer circumferential surface of the honeycomb core. The metal substrate for catalytic converter is characterized in that: the flat metal foil and the corrugated metal foil disposed in a gas inlet side joining section are joined to each other; the flat metal foil and the corrugated metal foil disposed in an outer circumferential joining section are joined to each other, the outer circumferential joining section is connected to an axial end section of the gas inlet side joining section; the gas inlet side joining section extends 5 mm or more and 50% or less of an entire length in an axial direction from a gas inlet side end section of the honeycomb core, across all layers in a radial direction of the honeycomb core; the outer circumferential joining section extends from the axial end section of the gas inlet side joining section toward a gas outlet side end section of the honeycomb core across two or more layers and ⅓ or less of the total number of layers in the radial direction from an outermost circumference of the honeycomb core; the outer jacket and the honeycomb core are joined by interposing a joining layer in gas outlet side end section area formed between the outer jacket and the honeycomb core and extending from the gas outlet side end section of the honeycomb core in the axial direction; when the joining layer has a length P in the axial direction, P fulfills the following formula (A); the corrugated metal foil has an impact mitigating section having different wave phases between a front and rear in the axial direction; and the impact mitigating section is formed in a region corresponding to at least the gas inlet side joining section and the outer circumferential joining section.

$$2\ \text{mm} \leq P \leq 50\ \text{mm} \quad \text{(A)}$$

(2) In the configuration according to the above-described (1), the P may fulfill the following formula (B).

$$5\ \text{mm} \leq P \leq 45\ \text{mm} \quad \text{(B)}$$

In order to achieve the above-described first and second objects, (3) the metal substrate for catalytic converter according to the above-described (1) or (2) is characterized in that: the impact mitigating section is formed by connecting continuous bodies, each including trapezoid-like gas channels continuously disposed in an orthogonal plane being orthogonal to the axial direction, in the axial direction with their phases shifted; and when the gas channel is divided into two regions according to a position corresponding to axially neighboring corrugated metal foils in a view in the axial direction, an area of one region is defined as S1, and an area of the other region is defined as S2, the area S1 and the area S2 are different from each other.

In order to achieve the first, second and third objects, (4) in the configuration according to the above-described (3), the area S1 and the area S2 may fulfill the following condition formula (C).

$$1.2 \leq S1/S2 \leq 10 \quad \text{(C)}$$

(5) In the configuration according to the above-described (3) or (4), the corrugated metal foil includes a pair of tapered sections that constitute side walls of the gas channel; and when Q is a pitch of the gas channel corresponding to a length of a line connecting respective midpoints of the pair of tapered sections, H is a height of the pair of tapered sections, and $\alpha$ is an angle formed between the radial direction and the tapered section, the following condition formula (D) or (E) is fulfilled.

$$0.15 \leq H/Q \leq 0.85 \quad \text{(D)}$$

$$5° \leq \alpha \leq 45° \quad \text{(E)}$$

(6) In the configurations according to the above-described (3) to (5), when L is a length of the trapezoid-like gas channel in the axial direction, the following condition formula (F) is fulfilled.

$$0.1\ \text{mm} \leq L \leq 100\ \text{mm} \quad \text{(F)}$$

Advantageous Effects of Invention

According to the invention of the present application, durability against cold and heat in the metal substrate for catalytic converter can be improved by limiting the joining region between the outer jacket and the honeycomb core to the gas outlet side end section of the honeycomb core. Furthermore, durability against impact in the metal substrate for catalytic converter can be improved by disposing an impact mitigating section having different wave phases between the front and rear in the axial direction.

DESCRIPTION OF EMBODIMENTS

Embodiment 1

Figure 1:
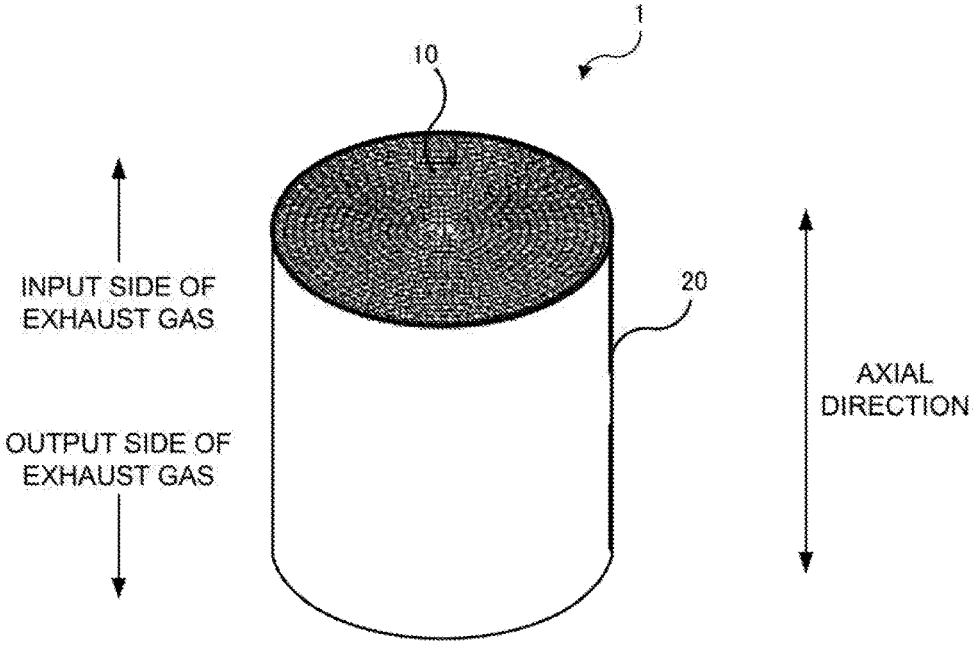
FIG. 1 is a perspective view of a metal substrate for catalytic converter.
Figure 2:
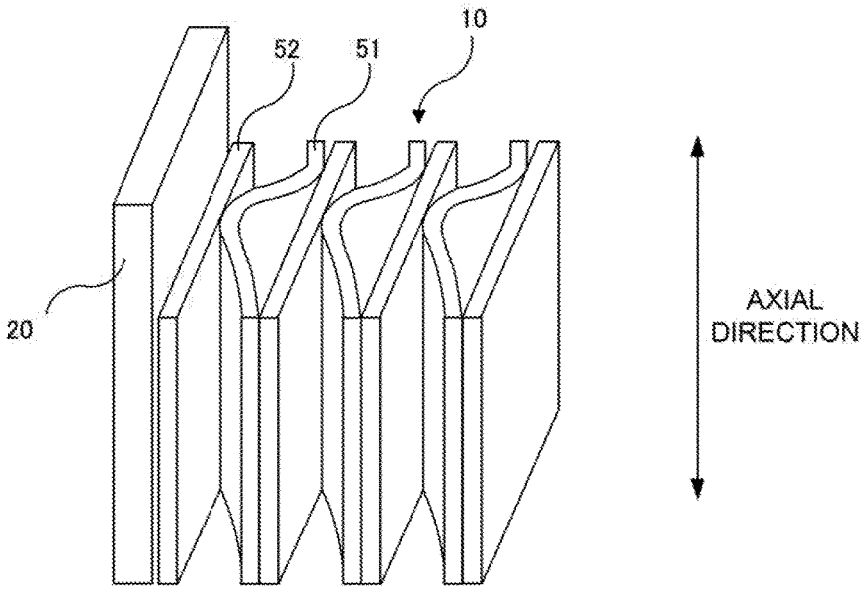
FIG. 2 is an enlarged perspective view of part of the metal substrate for catalytic converter.

The present embodiment will be described below on the basis of the drawings. FIG. 1 is a perspective view of a metal substrate for catalytic converter according to the present embodiment. FIG. 2 is an enlarged perspective view of part of the metal substrate for catalytic converter.

A metal substrate for catalytic converter 1 is constituted by a honeycomb core 10 and an outer jacket 20. A heat-resistant alloy can be used as the metal substrate for catalytic converter 1. As the heat-resistant alloy, there can be used Fe-20Cr-5Al stainless steel, and Fe-20Cr-5Al stainless steel joined with a highly heat-resistant brazing filler metal. However, various heat-resistant stainless steels containing Al in the alloy composition can also be used. A foil used in the metal substrate for catalytic converter 1 usually contains 15 to 25% by mass of Cr and 2 to 8% by mass of Al. For example, an Fe-18Cr-3Al alloy and an Fe-20Cr-8Al alloy can also be used as the heat-resistant alloy. The metal substrate for catalytic converter 1 can be installed in an exhaust gas path of a vehicle.

Figure 8:
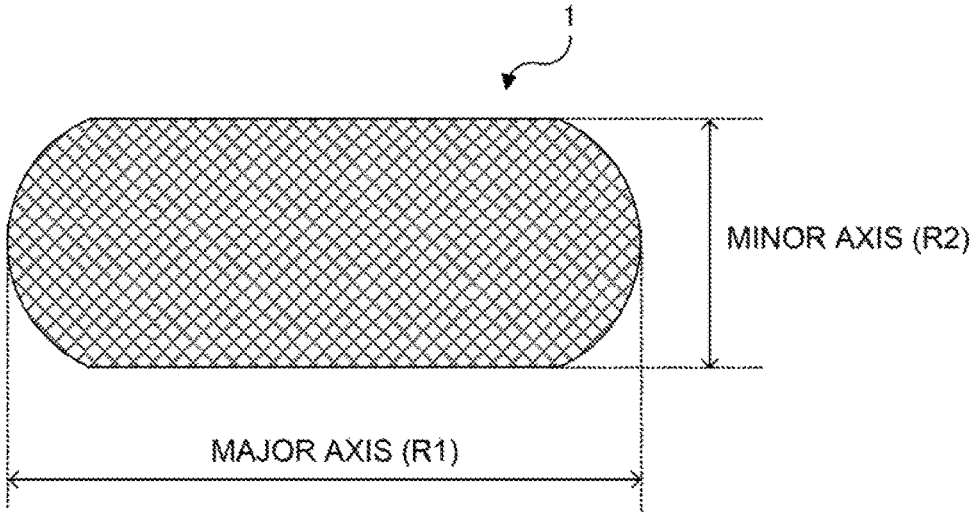
FIG. 8 is a schematic view of an RT-shaped honeycomb core as seen from the axial direction.

The honeycomb core 10 is formed in a roll shape by winding a long, wave-like corrugated metal foil 51 and a flat plate-like flat metal foil 52 around an axis in multiple layers, in a state where the foils are superimposed onto each other. By winding the corrugated metal foil 51 and the flat metal foil 52 in multiple layers in a state where the foils are superimposed onto each other, there is formed a plurality of channels each having the corrugated metal foil 51 and the flat metal foil 52 serving as side walls. The plurality of channels extends in the axial direction of the metal substrate for catalytic converter 1. The outer jacket 20 is formed in a cylindrical shape, and disposed in a position surrounding the outer circumferential surface in the radial direction of the honeycomb core 10. The inner surface of the outer jacket 20 and the outer surface of the honeycomb core 10 are partially joined, and details thereof will be described later. It is noted that the cross-sectional shape of the metal substrate for catalytic converter 1 is not limited to a circle. Other examples of the cross-sectional shape of the metal substrate for catalytic converter 1 may include an oval, ovoid, and racetrack (hereinafter, referred to as RT). FIG. 8 is a schematic view of an RT-shaped honeycomb core seen from the axial direction, in which R1 is a major axis, and R2 is a minor axis.

The honeycomb core 10 may carry a catalyst. The honeycomb core 10 can carry a catalyst by supplying a wash coat liquid (a solution containing γ alumina and an additive as well as a precious metal catalyst as a component) into the channels of the honeycomb core 10, and baking the supplied liquid to the honeycomb core 10 by a high-temperature heat treatment. Exhaust gas is purified by reacting with the catalyst while passing through the channels of the honeycomb core 10.

Figure 3:
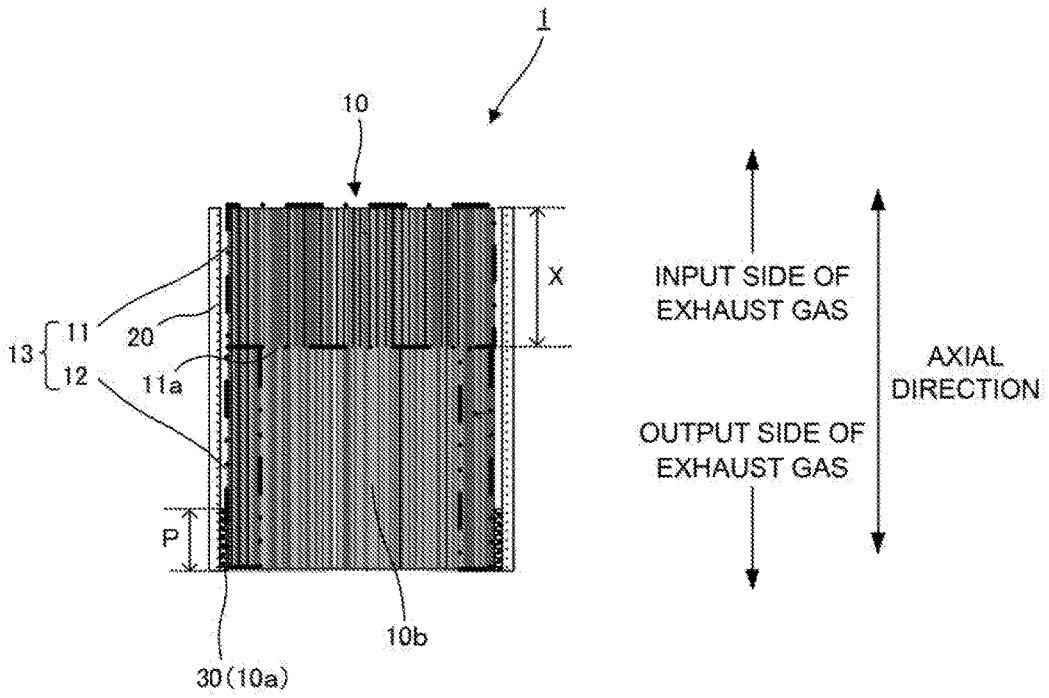
FIG. 3 is a cross-sectional view of the metal substrate for catalytic converter.

FIG. 3 is a cross-sectional view cut along the axial direction of the metal substrate for catalytic converter 1. A joining layer is formed between the outer circumferential surface of the honeycomb core 10 and the inner circumferential surface of the outer jacket 20. The honeycomb core 10 and the outer jacket 20 are partially joined through the joining layer 30. The joining layer 30 is formed only in a gas outlet side end section area 10*a* of the honeycomb core 10, and disposed at a plurality of locations in the circumferential direction of the honeycomb core 10 (the outer jacket 20) at a prescribed spacing. However, the joining layer 30 may also be formed around the entire honeycomb core 10 (the entire outer jacket 20) in the circumferential direction in the gas outlet side end section area 10*a*. A Ni brazing filler metal having high heat resistance can be used as the joining layer 30.

Here, the joining layer 30 extends from a gas outlet side end section of the honeycomb core 10 in the axial direction. When the length of the joining layer 30 in the axial direction is defined to be P, the P is 50 mm or less, and preferably 45 mm or less.

Figure 4:
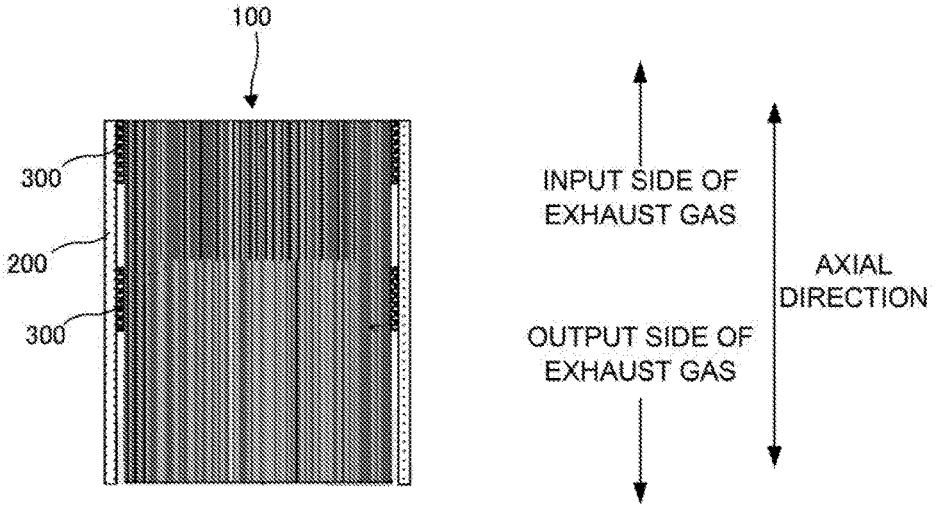
FIG. 4 is a cross-sectional view of a metal substrate for catalytic converter (Comparative Example).

By comparing and referring to FIG. 3 and FIG. 4, the reason for limiting the formation area of the joining layer 30 to the gas outlet side end section area 10*a* will be described. FIG. 4 is a cross-sectional view of a metal substrate for catalytic converter according to a comparative example, and corresponds to FIG. 3. By referring to FIG. 4, the metal substrate for catalytic converter according to the comparative example includes a joining layer 300 in a gas inlet side end section of a honeycomb core 100 or in an axial center of the honeycomb core 100. The honeycomb core during a temperature rising process has the following temperature characteristics. Exhaust gas flows from a gas inlet side end section of the metal substrate for catalytic converter into a channel of the honeycomb core, and exchanges heat with the honeycomb core thereby to gradually decrease in temperature. Therefore, the temperature distribution in the axial direction of the metal substrate for catalytic converter during a temperature rising process is not uniform. The temperature gradually decreases from the gas inlet side end section toward the gas outlet side end section. In brief, the metal substrate for catalytic converter has larger temperature variations as being closer to the gas inlet side. Accordingly, when the joining layer 300 is formed in the gas inlet side end section or axial center of the metal substrate for catalytic converter, durability against cold and heat deteriorates. For this reason, in the configuration of the comparative example, repeating a temperature rising process is likely to cause the honeycomb core 100 to drop off from an outer jacket 200.

Therefore, the joining layer 30 needs to be formed in the gas outlet side end section of the honeycomb core in order to improve durability against cold and heat of the metal substrate for catalytic converter. On the other hand, when the axial dimension of the joining layer 30 increases, an increased joining area causes the honeycomb core 10 to have increased restrained area, and the axial end section of the joining layer 30 approaches the gas inlet side end section having large temperature variations. Consequently, durability against cold and heat deteriorates.

To address this concern, in the invention according to the present application, the formation area of the joining layer 30 is limited to the gas outlet side end section while the upper limit of the axial length P of the joining layer 30 is limited to 50 mm. That is, satisfying these conditions allows the formation area of the joining layer 30 to be limited to a region having small temperature variations. Consequently, durability against cold and heat can be improved.

Furthermore, in the invention according to the present application, the corrugated metal foil 51 and the flat metal foil 52 in a gas inlet side joining section 11 and an outer circumferential joining section 12 of the honeycomb core 10 are joined to each other, in order to further enhance durability against cold and heat of the metal substrate for catalytic converter 1. A brazing filler metal can be used for joining. As the brazing filler metal, a Ni brazing filler metal having high heat resistance can be used. The gas inlet side joining section 11 is formed to extend from the gas inlet side end section of the honeycomb core 10 in the axial direction. When the length of the gas inlet side joining section 11 is defined to be X, the X is 5 mm or more and 50% or less of the overall length in the axial direction. The gas inlet side joining section 11 is formed across all layers in the radial direction of the honeycomb core 10. It is noted that in FIG. 3, a region where the gas inlet side joining section 11 is to be formed is surrounded by a dot-and-dash line. The outer circumferential joining section 12 is formed from an axial end section 11*a* of the gas inlet side joining section 11 toward the gas outlet side end section of the honeycomb core 10 across two or more layers and ⅓ or less of the total number of layers in the radial direction from the outermost circumference of the honeycomb core 10. It is noted that in FIG. 3, a region where the outer circumferential joining section 12 is to be formed is surrounded by a double dot-and-dash line. The axial end section 11*a* of the gas inlet side joining section 11 means an end section opposite to the gas inlet side end section in the axial direction of the gas inlet side joining section 11, that is, a lower surface of the gas inlet side joining section 11. The total number of layers means the number of layers of the corrugated metal foil 51 from the center to the outermost circumference of the honeycomb core 10.

During the temperature rising process of the metal substrate for catalytic converter 1, a time during which the metal substrate for catalytic converter 1 is exposed to high-temperature exhaust gas becomes longer in the center section than in the outer circumferential section. Therefore, difference in temperature between the center section and the outer circumferential section of the honeycomb core 10 causes heat distortion to occur. Furthermore, foil elongation is caused in the center section, which also leads to occurrence of heat distortion. By joining the corrugated metal foil 51 and the flat metal foil 52 to each other in the gas inlet side joining section 11 and the outer circumferential joining section 12 of the honeycomb core 10, the corrugated metal foil 51 and the flat metal foil 52 in a center section 10*b* in the radial direction on the gas outlet side can be each independently deformed. Consequently, stress can be mitigated. This can further improve durability against cold and heat of the metal substrate for catalytic converter 1.

The present inventors has also intensively conducted research on the structure of the honeycomb core 10 that can improve both durability against cold and heat and durability against impact as described above. As a result, the following finding has been obtained. Vibration is added to the metal substrate for catalytic converter 1 while a vehicle is running, and this vibration is transmitted to the joining layer 30 through the corrugated metal foil 51. This causes joining strength between the honeycomb core 10 and the outer jacket 20 to be reduced. In the present invention, the axial length P of the joining layer 30 is particularly limited to 50 mm or less in order to improve durability against cold and heat. Therefore, durability against impact cannot be improved by increasing the axial length of the joining layer 30. Under such circumstances, the present inventors has intensively conducted research on the structure that inhibits vibration added to the honeycomb core 10 from being transmitted to the joining layer 30, and has found that an impact mitigating section 13 having different phases between the front and rear in the axial direction is disposed to at least part of the corrugated metal foil 51.

Figure 5:
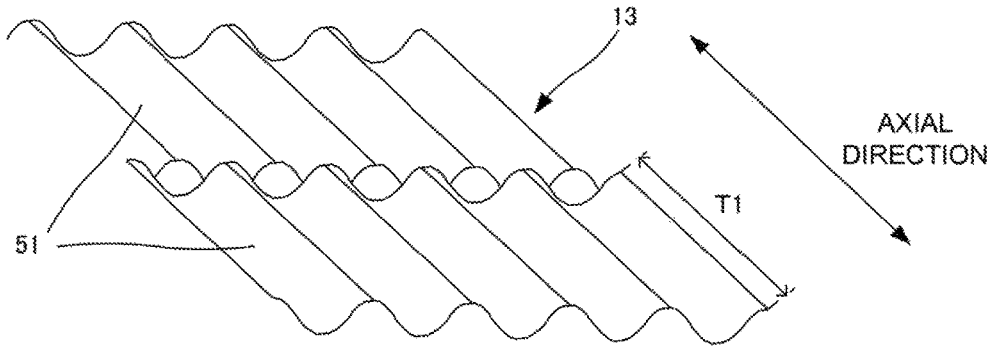
FIG. 5 is an enlarged perspective view of part of a corrugated metal foil constituting an impact mitigating section.

The impact mitigating section 13 is formed in the gas inlet side joining section 11 and the outer circumferential joining section 12. FIG. 5 is a development diagram of part of the impact mitigating section 13 formed to the corrugated metal foil 51. The corrugated metal foil 51 is bent alternately between the front and rear sides in the radial direction, and the impact mitigating section 13 is configured to have different wave phases between the front and rear in the axial direction. In brief, the impact mitigating section 13 is constituted by an offset structure in which the wave phases aligned in the axial direction are shifted by a predetermined range. Disposition of the impact mitigating section 13 enables impact force to be cut (mitigated) between the waves having different phases. This can provide both durability against cold and heat and durability against impact of the metal substrate for catalytic converter 1. Furthermore, adoption of the offset structure causes exhaust gas to crash against a wall section of the honeycomb core 10 and be agitated. Consequently, purification performance can be enhanced. Especially, disposition of the impact mitigating section 13 to the gas inlet side joining section 11 can increase the effect of improving purification performance.

Disposition of the above-described impact mitigating section 13 enables the lower limit of the axial length P of the joining layer 30 to be limited to 2 mm. In brief, if at least 2 mm is ensured for the axial length P of the joining layer 30, durability against impact can be ensured. A summary of the above-described finding is that the axial length P of the joining layer 30 fulfills the following formula (A), and preferably fulfills the following formula (B).

$$2\text{ mm} \leq P \leq 50\text{ mm} \quad \text{(A)}$$

$$5\text{ mm} \leq P \leq 45\text{ mm} \quad \text{(B)}$$

When the formula (A) is fulfilled, the metal substrate for catalytic converter 1 can provide both durability against cold and heat and durability against impact. When the formula (B) is fulfilled, the above-described effect can be further enhanced.

The impact mitigating section 13 in the present embodiment is formed only in the gas inlet side joining section 11 and the outer circumferential joining section 12 of the honeycomb core 10. In other sections of the honeycomb core 10, all wave phases are the same between the front and rear in the axial direction. In this manner, by forming a joining region between the corrugated metal foil 51 and the flat metal foil 52 and the impact mitigating section 13 having different wave phases between the front and rear in the axial direction in an overlapped position, the impact mitigation effect by the impact mitigating section 13 can be enhanced. That is, since unification of the corrugated metal foil 51 and the flat metal foil 52 facilitates transmission of vibration in the joining region, formation of the impact mitigating section 13 in the joining region can effectively suppress propagation of vibration to the joining layer 30. Furthermore, formation of the joining region and the impact mitigating section 13 in the overlapped position facilitates determination of the joining region. Therefore, the joining process can be simplified. In brief, since the impact mitigating section 13 and other regions (regions where the impact mitigating section is not disposed to the corrugated metal foil 51) are easily distinguished from each other in a visual manner, a range to be brazed can be easily determined.

However, the impact mitigating section 13 may be expanded to a region outside the gas inlet side joining section 11 and the outer circumferential joining section 12. In this case, although more complicated structure of the honeycomb core 10 causes the manufacturing process to become complex, impact force propagated to the joining layer 30 can be mitigated more reliably.

Figure 6:
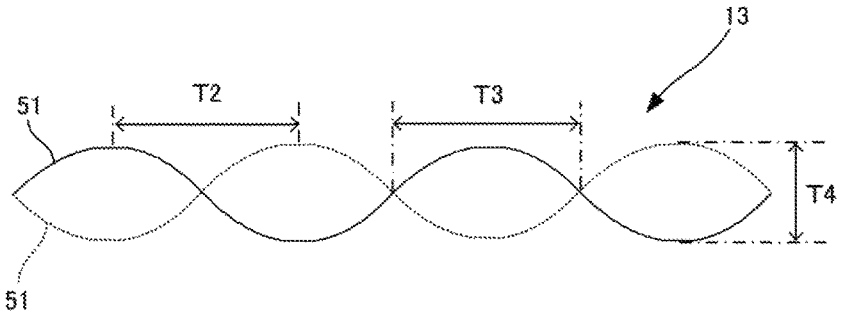
FIG. 6 is a cross-sectional view of part of the corrugated metal foil constituting the impact mitigating section.

With reference to FIG. 5 and FIG. 6, a dimension condition of the impact mitigating section 13 will be described. FIG. 6 is a cross-sectional view of part of the impact mitigating section 13, in which one of axially neighboring waves is indicated by a solid line, and the other is indicated by a dotted line. The impact mitigating section 13 according to the present embodiment has a sine curve shape in an axial view. In FIG. 5 and FIG. 6, T1 is an offset width, T2 is a phase shift, T3 is a wave pitch, and T4 is a wave height. The offset width T1 means the axial length of waves having the same phase. The offset width T1 is preferably 0.5 mm or more and 50 mm or less. When the offset width T1 becomes less than 0.5 mm, pressure loss increases. When the offset width T1 exceeds 50 mm, the number of offset locations for cutting the impact force decreases, thereby reducing impact mitigation ability. The phase shift T2 means the amount of phase shift between axially neighboring waves. The phase shift T2 is preferably 0.05 mm or more and 5 mm or less. When the phase shift T2 becomes less than 0.05 mm, an overlapping region between the axially neighboring waves increases, thereby reducing impact force mitigation ability. When the phase shift T2 exceeds 5 mm, the contact surface area between the honeycomb core 10 and exhaust gas decreases, thereby reducing purification performance. The wave pitch T3 means the length in the circumferential direction (the circumferential direction of the honeycomb core 10) of the crest (or the trough) of a wave. When the shape of a wave is a sine wave, the length of the half-wavelength of the wave becomes the wave pitch T3. The wave pitch T3 is preferably 0.1 mm or more and 5 mm or less. When the wave pitch T3 becomes less than 0.1 mm, the exhaust gas channel is narrowed, thereby increasing pressure loss. When the wave pitch T3 exceeds 5 mm, the contact surface between the honeycomb core 10 and exhaust gas decreases, thereby reducing purification performance. The wave height T4 means a difference in height between the crest and the trough of a wave. The wave height T4 is preferably 0.1 mm or more and 5 mm or less. When the wave height T4 becomes less than 0.1 mm, the exhaust gas channel is narrowed, thereby increasing pressure loss. When the wave height T4 exceeds 5 mm, the contact surface area between the honeycomb core 10 and exhaust gas decreases, thereby reducing purification performance.

Figure 7:
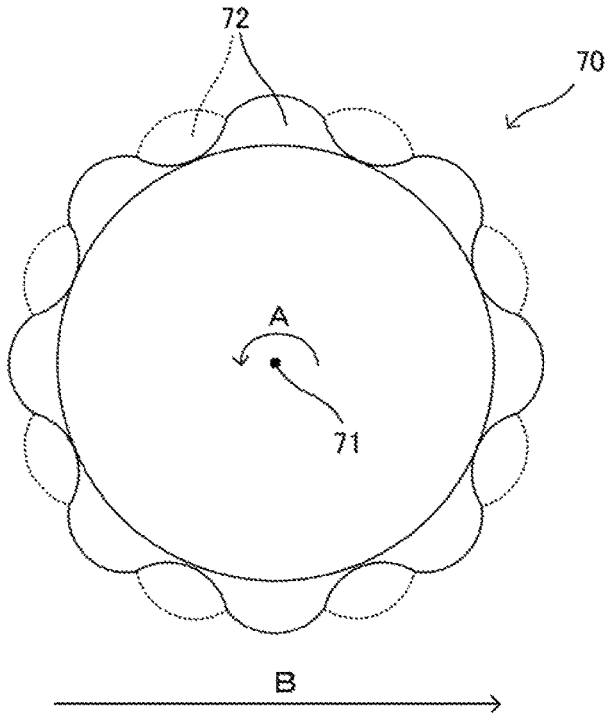
FIG. 7 is a schematic cross-sectional view of a jig for manufacturing an impact mitigating section.

The impact mitigating section 13 can be manufactured with, for example, a jig illustrated in FIG. 7. FIG. 7 is a cross-sectional view of the jig, and an element that does not appear on the cross section is indicated by a dotted line in a perspective manner. An arrow A indicates the rotation direction of the jig, and an arrow B indicates the conveying direction of a base foil that serves as a base material of the corrugated metal foil 51. The jig 70 has a roll shape, and rotates around a shaft 71 extending in the normal direction of the sheet surface. The jig 70 includes, on its outer peripheral surface, a concave convex shape section 72 corresponding to the shape of the impact mitigating section 13. The concave convex shape section 72 includes a portion indicated by a solid line and a portion indicated by a dotted line. These portions are adjacent to each other in the shaft 71 direction, and each extend in the shaft 71 direction. While the concave convex shape section 72 abuts against a base foil, the jig 70 is rotated in the arrow A direction, and the base foil draws in the arrow B direction. Accordingly, the impact mitigating section 13 can be formed in a region corresponding to the gas inlet side joining section 11 and the outer circumferential joining section 12 of the corrugated metal foil 51.

Second Embodiment

Figure 9:
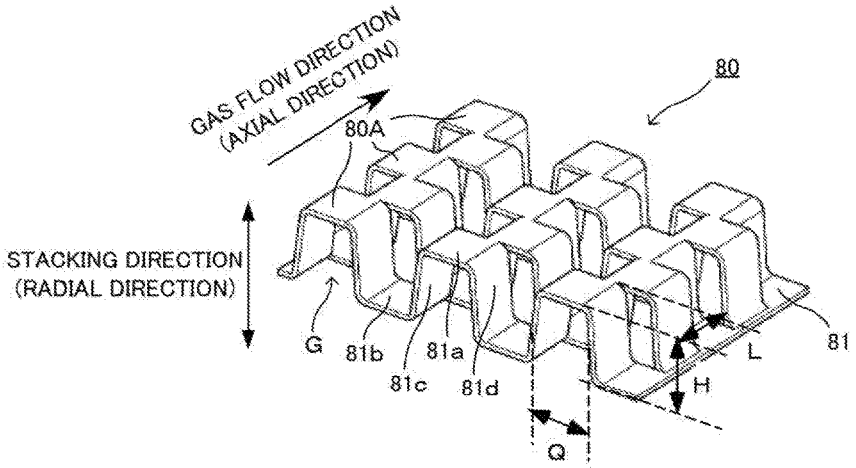
FIG. 9 is an appearance perspective view of part of a corrugated metal foil (Embodiment 2).
Figure 10:
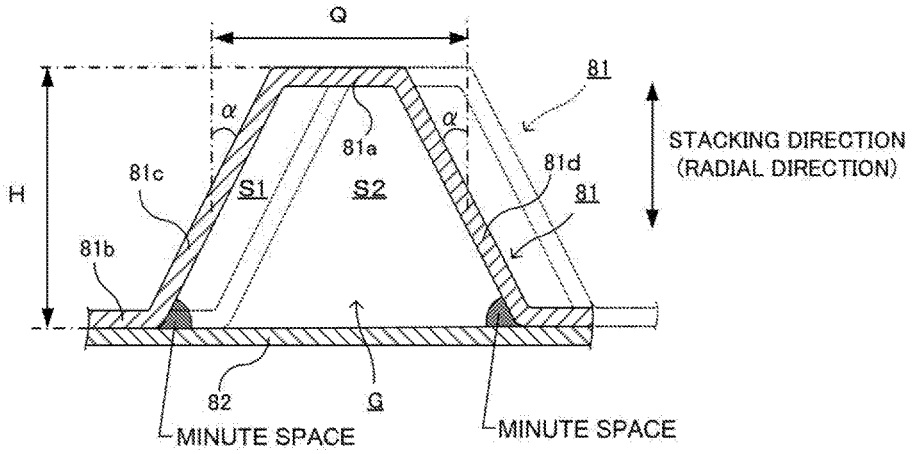
FIG. 10 is an appearance view of axially neighboring corrugated metal foils.

The present embodiment is different from the first embodiment in terms of the shape of the impact mitigating section. FIG. 9 is an appearance perspective view of part of a corrugated metal foil. FIG. 10 is an appearance view of axially neighboring corrugated metal foils. An impact mitigating section 80 is configured by connecting continuous bodies 80A, each including trapezoid-like gas channels G continuously disposed in an orthogonal plane being orthogonal to the axial direction, in the axial direction with their phases shifted (offset). The trapezoid-like gas channel G is formed between a corrugated metal foil 81 stacked in a layered manner and a flat metal foil 82. The corrugated metal foil 81 is constituted by a first flat section 81*a*, a second flat section 81*b*, a first tapered section 81*c*, and a second tapered section 81*d*. The first and second flat sections 81*a* and 81*b* extending the direction orthogonal to the axial direction, and the first flat section 81*a* is located in the further outside in the radial direction of the honeycomb core than the second flat section 81*b*. The first and second tapered sections 81*c* and 81*d* extend from both ends of the first flat section 81*a* toward the inner side in the radial direction in a widening manner, and the leading end sides thereof are connected to the second flat section 81*b*. This allows continuous formation of the trapezoid-like gas channel G having an upper bottom and a lower bottom alternately changed in place around the axis.

Here, as illustrated in FIG. 10, when the gas channel G is divided into two regions according to the position corresponding to axially neighboring corrugated metal foils 81, an area of one region is defined as S1, and an area of the other region is defined as S2. In this case, the offset amount between the axially neighboring corrugated metal foils 81 is preferably adjusted in advance so that the area S1 and the area S2 are different from each other. This allows gas flowing into each of the area S1 and the area S2 to have a different flow velocity, thereby enabling generation of a turbulent flow. Generation of the turbulent flow increases an area where gas comes into contact with the corrugated metal foil 81 and the flat metal foil 82, thereby enabling further improvement of purification performance.

When the area S1 and the area S2 are different from each other, a turbulent flow can be generated. However, when the following condition formula (C) is fulfilled, a further favorable effect can be obtained.

$$1.2 \leq S1/S2 \leq 10 \quad \text{(C)}$$

When S1/S2 is 1.2 or more, the effect of improving purification performance by the generation of a turbulent flow can be sufficiently enhanced. When S1/S2 is limited to 10 or less, pressure loss by decrease of the area S1 can be inhibited from increasing.

Furthermore, when the pitch of the gas channel G is Q, the height of the first tapered section 81*c* (the second tapered section 81*d*) is H, and the angle formed between the stacking direction and the first tapered section 81*c* (the second tapered section 81*d*) is α, the following condition formula (D) or (E) is preferably fulfilled. The pitch Q means the length of a line connecting the respective midpoints of the first tapered section 81*c* and the second tapered section 81*d*. The height H of the first tapered section 81*c* (the second tapered section 81*d*) means the height in the stacking direction (in other words, the radial direction of the honeycomb core).

$$0.15 \leq H/Q \leq 0.85 \quad \text{(D)}$$

$$5° \leq \alpha \leq 45° \quad \text{(E)}$$

That is, the present inventors have found that formation of the gas channels G each having a flat shape can mitigate the condition for the transition from a laminar flow to a turbulent flow, such as flow velocity, while suppressing increase of pressure loss. When H/Q fulfills the range of the condition formula (D), the above-described mitigation effect can be enhanced, and purification performance can be improved. A more preferred condition of H/Q is 0.25 or more and 0.80 or less. It is noted that H is preferably 0.1 mm or more and 10 mm or less, and S is preferably 0.1 mm or more and 10 mm or less.

The present inventors have found that disposition of the first tapered section 81*c* (the second tapered section 81*d*) (that is, the shape of the gas channel G is not rectangular but trapezoidal) can improve purification performance while suppressing increase of pressure loss. It is inferred that this effect of improving purification performance is obtained by increasing the surface area of the gas channel G due to increase of a and promoting generation of a turbulent flow from a gas stream. That is, when a becomes 5° or more, a turbulent flow is likely to be generated in the gas channel G, and increase of the surface area is sufficient. Therefore, purification performance is further enhanced. When a is limited to 45° or less, a minute space, indicated by hatching, formed between the leading edge of the first tapered section 81*c* (the second tapered section 81*d*) and the flat metal foil 82 can be widened. This facilitates flowing of gas into this space, and ensures contact between gas and a catalyst carried in this space. Therefore, purification performance can be further enhanced. However, the present embodiment is configured such that when a gas stream becomes a turbulent flow, gas is also likely to flow into the minute space. Therefore, even when a exceeds 45°, decrease of purification performance can be mitigated.

When the axial length of each gas channel G is defined to be L, the following condition formula (F) is preferably fulfilled.

$$0.1 \text{ mm} \leq L \leq 100 \text{ mm} \quad \text{(F)}$$

When the L is 0.1 mm or more, pressure loss can be reduced. When the L is 100 mm or less, the effect of improving purification performance due to offsetting of the continuous bodies 80A can be enhanced.

Example 1

Next, the present invention will be specifically described by illustrating an example. Example 1 corresponds to Embodiment 1. The effect of the present invention was examined by preparing a metal substrate for catalytic converter having a cylindrical shape or an RT shape according to various specifications, and then evaluating durability against cold and heat and durability against impact of the prepared metal substrate for catalytic converter. Table 1 to Table 3 show various specifications and evaluation results thereof.

TABLE 1

| | CARRIER CONDITION | | | HONEYCOMB BODY DIMENTION | | JOINING STRUCTURE: BRAZING SECTION | | JOINING STRUCTURE: HONEYCOMB BODY-OUTER TUBE JOINING POSITION FROM OUTPUT SIDE END SURFACE | IMPACT MITIGATING STRUCTURE BRAZING SECTION | | | |
|---|---|---|---|---|---|---|---|---|---|---|---|---|
| No. | SHAPE | FOIL THICKNESS μm | OUTER TUBE THICKNESS mm | R mm | L mm | X mm | OUTER CIRCUMFERENTIAL JOINING | P mm | T1 mm | T2 mm | T3 mm | T4 mm |
| 1 | CYLINDER | 30 | 1.5 | 110 | 98 | 20 | 3 LAYERS | 25 | 0 | 0 | 0 | 1 | 1 |
| 2 | CYLINDER | 30 | 1.5 | 110 | 98 | 20 | 3 LAYERS | 25 | 0 | 0 | 0 | 1 | 1 |
| 3 | CYLINDER | 30 | 1.5 | 110 | 98 | 20 | 3 LAYERS | 25 | 0 | 0 | 0 | 1 | 1 |
| 4 | CYLINDER | 30 | 1.5 | 110 | 98 | 20 | 3 LAYERS | 25 | 45 | 2 | 1 | 1 | 1 |
| 5 | CYLINDER | 30 | 1.5 | 110 | 98 | 20 | 3 LAYERS | 1.5 | 0 | 2 | 1 | 1 | 1 |
| 6 | CYLINDER | 30 | 1.5 | 110 | 98 | 20 | 3 LAYERS | 2 | 0 | 2 | 1 | 1 | 1 |
| 7 | CYLINDER | 30 | 1.5 | 110 | 98 | 20 | 3 LAYERS | 5 | 0 | 2 | 1 | 1 | 1 |
| 8 | CYLINDER | 30 | 1.5 | 110 | 98 | 20 | 3 LAYERS | 10 | 0 | 2 | 1 | 1 | 1 |
| 9 | CYLINDER | 30 | 1.5 | 110 | 98 | 20 | 3 LAYERS | 25 | 0 | 2 | 1 | 1 | 1 |
| 10 | CYLINDER | 30 | 1.5 | 110 | 98 | 20 | 3 LAYERS | 45 | 0 | 2 | 1 | 1 | 1 |
| 11 | CYLINDER | 30 | 1.5 | 110 | 98 | 20 | 3 LAYERS | 50 | 0 | 2 | 1 | 1 | 1 |
| 12 | CYLINDER | 30 | 1.5 | 110 | 98 | 20 | 3 LAYERS | 55 | 0 | 2 | 1 | 1 | 1 |
| 13 | CYLINDER | 30 | 1.5 | 110 | 98 | 20 | 1 LAYER | 25 | 0 | 2 | 1 | 1 | 1 |
| 14 | CYLINDER | 30 | 1.5 | 110 | 98 | 20 | TOTAL NUMBER OF LAYERS ¼ | 25 | 0 | 2 | 1 | 1 | 1 |
| 15 | CYLINDER | 30 | 1.5 | 110 | 98 | 20 | TOTAL NUMBER OF LAYERS ⅓ | 25 | 0 | 2 | 1 | 1 | 1 |
| 16 | CYLINDER | 30 | 1.5 | 110 | 98 | 20 | TOTAL NUMBER OF LAYERS ⅔ | 25 | 0 | 2 | 1 | 1 | 1 |
| 17 | CYLINDER | 30 | 1.5 | 110 | 98 | 0 | 3 LAYERS | 25 | 0 | 2 | 1 | 1 | 1 |
| 18 | CYLINDER | 30 | 1.5 | 110 | 98 | 5 | 3 LAYERS | 25 | 0 | 2 | 1 | 1 | 1 |
| 19 | CYLINDER | 30 | 1.5 | 110 | 98 | 49 | 3 LAYERS | 25 | 0 | 2 | 1 | 1 | 1 |
| 20 | CYLINDER | 30 | 1.5 | 110 | 98 | 52 | 3 LAYERS | 25 | 0 | 2 | 1 | 1 | 1 |
| 21 | CYLINDER | 30 | 1.5 | 110 | 98 | 20 | 3 LAYERS | 25 | 0 | 0.5 | 1 | 1 | 1 |
| 22 | CYLINDER | 30 | 1.5 | 110 | 98 | 20 | 3 LAYERS | 25 | 0 | 1 | 1 | 1 | 1 |
| 23 | CYLINDER | 30 | 1.5 | 110 | 98 | 20 | 3 LAYERS | 25 | 0 | 5 | 1 | 1 | 1 |
| 24 | CYLINDER | 30 | 1.5 | 110 | 98 | 20 | 3 LAYERS | 25 | 0 | 10 | 1 | 1 | 1 |
| 25 | CYLINDER | 30 | 1.5 | 110 | 98 | 20 | 3 LAYERS | 25 | 0 | 20 | 1 | 1 | 1 |
| 26 | CYLINDER | 30 | 1.5 | 110 | 98 | 20 | 3 LAYERS | 25 | 0 | 50 | 1 | 1 | 1 |
| 27 | CYLINDER | 30 | 1.5 | 110 | 98 | 20 | 3 LAYERS | 25 | 0 | 0.5 | 1 | 1 | 1 |
| 28 | CYLINDER | 30 | 1.5 | 110 | 98 | 20 | 3 LAYERS | 25 | 0 | 1 | 1 | 1 | 1 |
| 29 | CYLINDER | 30 | 1.5 | 110 | 98 | 20 | 3 LAYERS | 25 | 0 | 2 | 1 | 1 | 1 |
| 30 | CYLINDER | 30 | 1.5 | 110 | 98 | 20 | 3 LAYERS | 25 | 0 | 5 | 1 | 1 | 1 |
| 31 | CYLINDER | 30 | 1.5 | 110 | 98 | 20 | 3 LAYERS | 25 | 0 | 10 | 1 | 1 | 1 |
| 32 | CYLINDER | 30 | 1.5 | 110 | 98 | 20 | 5 LAYERS | 25 | 0 | 20 | 1 | 1 | 1 |
| 33 | CYLINDER | 30 | 1.5 | 110 | 98 | 20 | 3 LAYERS | 25 | 0 | 50 | 1 | 1 | 1 |
| 34 | CYLINDER | 30 | 1.5 | 110 | 98 | 20 | 3 LAYERS | 25 | 0 | 2 | 0.5 | 1 | 1 |
| 35 | CYLINDER | 30 | 1.5 | 110 | 98 | 20 | 3 LAYERS | 25 | 0 | 2 | 0.1 | 1 | 1 |
| 36 | CYLINDER | 30 | 1.5 | 110 | 98 | 20 | 3 LAYERS | 25 | 0 | 2 | 0.04 | 1 | 1 |

| | IMPACT MITIGATING STRUCTURE NON-BRAZING SECTION | | | | | | | | DURABILITY TEST EVALUATION | | |
|---|---|---|---|---|---|---|---|---|---|---|---|
| No. | T1 mm | T2 mm | T3 mm | T4 mm | CONDITION 1 | CONDITION 2 | CONDITION 3 | CONDITION 4 | COLD AND HEAT | IMPACT | REMARKS |
| 1 | 0 | 0 | 1 | 1 | B | B | A | D | B | D | COMPARATIVE EXAMPLE 1 |

TABLE 1-continued

| | | | | | | | | | | | |
|---|---|---|---|---|---|---|---|---|---|---|---|
| 2 | 0 | 0 | 1 | 1 | B | B | A | D | B | D | COMPARATIVE EXAMPLE 2 |
| 3 | 2 | 1 | 1 | 1 | B | B | A | D | B | D | COMPARATIVE EXAMPLE 3 |
| 4 | 0 | 0 | 1 | 1 | B | B | D | B | D | D | COMPARATIVE EXAMPLE 4 |
| 5 | 0 | 0 | 1 | 1 | B | B | D | B | C | D | COMPARATIVE EXAMPLE 5 |
| 6 | 0 | 0 | 1 | 1 | B | B | B | B | C | C | INVENTION EXAMPLE 1 |
| 7 | 0 | 0 | 1 | 1 | B | B | A | B | B | B | INVENTION EXAMPLE 2 |
| 8 | 0 | 0 | 1 | 1 | B | B | A | B | B | B | INVENTION EXAMPLE 3 |
| 9 | 0 | 0 | 1 | 1 | B | B | A | B | B | B | INVENTION EXAMPLE 4 |
| 10 | 0 | 0 | 1 | 1 | B | B | A | B | B | B | INVENTION EXAMPLE 5 |
| 11 | 0 | 0 | 1 | 1 | B | B | B | B | C | C | INVENTION EXAMPLE 6 |
| 12 | 0 | 0 | 1 | 1 | B | B | D | B | D | D | COMPARATIVE EXAMPLE 6 |
| 13 | 0 | 0 | 1 | 1 | B | D | A | B | D | D | COMPARATIVE EXAMPLE 7 |
| 14 | 0 | 0 | 1 | 1 | B | B | A | B | B | B | INVENTION EXAMPLE 7 |
| 15 | 0 | 0 | 1 | 1 | B | B | A | B | B | B | INVENTION EXAMPLE 8 |
| 16 | 0 | 0 | 1 | 1 | B | D | A | B | D | D | COMPARATIVE EXAMPLE 8 |
| 17 | 0 | 0 | 1 | 1 | D | B | A | B | D | D | COMPARATIVE EXAMPLE 9 |
| 18 | 0 | 0 | 1 | 1 | B | B | A | B | B | B | INVENTION EXAMPLE 9 |
| 19 | 0 | 0 | 1 | 1 | B | B | A | B | B | B | INVENTION EXAMPLE 10 |
| 20 | 0 | 0 | 1 | 1 | D | B | A | B | D | D | COMPARATIVE EXAMPLE 10 |
| 21 | 0 | 0 | 1 | 1 | B | B | A | B | B | B | INVENTION EXAMPLE 11 |
| 22 | 0 | 0 | 1 | 1 | B | B | A | B | B | B | INVENTION EXAMPLE 12 |
| 23 | 0 | 0 | 1 | 1 | B | B | A | B | B | B | INVENTION EXAMPLE 13 |
| 24 | 0 | 0 | 1 | 1 | B | B | A | B | B | B | INVENTION EXAMPLE 14 |
| 25 | 0 | 0 | 1 | 1 | B | B | A | B | B | B | INVENTION EXAMPLE 15 |
| 26 | 0 | 0 | 1 | 1 | B | B | A | B | B | C | INVENTION EXAMPLE 16 |
| 27 | 2 | 1 | 1 | 1 | B | B | A | B | B | B | INVENTION EXAMPLE 17 |
| 28 | 2 | 1 | 1 | 1 | B | B | A | B | B | B | INVENTION EXAMPLE 18 |
| 29 | 2 | 1 | 1 | 1 | B | B | A | B | B | B | INVENTION EXAMPLE 19 |
| 30 | 2 | 1 | 1 | 1 | B | B | A | B | B | B | INVENTION EXAMPLE 20 |
| 31 | 2 | 1 | 1 | 1 | B | B | A | B | B | B | INVENTION EXAMPLE 21 |
| 32 | 2 | 1 | 1 | 1 | B | B | A | B | B | B | INVENTION EXAMPLE 22 |
| 33 | 2 | 1 | 1 | 1 | B | B | A | B | B | C | INVENTION EXAMPLE 23 |
| 34 | 0 | 0 | 1 | 1 | B | B | A | B | B | B | INVENTION EXAMPLE 24 |
| 35 | 0 | 0 | 1 | 1 | B | B | A | B | B | B | INVENTION EXAMPLE 25 |
| 36 | 0 | 0 | 1 | 1 | B | B | A | B | B | C | INVENTION EXAMPLE 26 |

TABLE 2

| No. | CARRIER CONDITION SHAPE | FOIL THICKNESS μm | OUTER TUBE THICKNESS mm | HONEYCOMB BODY DIMENTION R mm | HONEYCOMB BODY DIMENTION L mm | JOINING STRUCTURE BRAZING SECTION X mm | JOINING STRUCTURE BRAZING SECTION OUTER CIRCUMFERENTIAL JOINING | JOINING STRUCTURE HONEYCOMB BODY-OUTER TUBE JOINING POSITION P mm | JOINING STRUCTURE HONEYCOMB BODY-OUTER TUBE JOINING POSITION FROM OUTPUT SIDE END SURFACE mm | IMPACT MITIGATING STRUCTURE BRAZING SECTION T1 mm | IMPACT MITIGATING STRUCTURE BRAZING SECTION T2 mm | IMPACT MITIGATING STRUCTURE BRAZING SECTION T3 mm | IMPACT MITIGATING STRUCTURE BRAZING SECTION T4 mm |
|---|---|---|---|---|---|---|---|---|---|---|---|---|---|
| 37 | CYLINDER | 50 | 1.5 | 85 | 110 | 25 | 2 LAYERS | 20 | 0 | 0 | 0 | 2 | 2.2 |
| 38 | CYLINDER | 50 | 1.5 | 85 | 110 | 25 | 2 LAYERS | 20 | 0 | 0 | 0 | 2 | 2.2 |
| 39 | CYLINDER | 50 | 1.5 | 85 | 110 | 25 | 2 LAYERS | 20 | 0 | 0 | 0 | 2 | 2.2 |
| 40 | CYLINDER | 50 | 1.5 | 85 | 110 | 25 | 2 LAYERS | 20 | 50 | 6 | 2 | 2 | 2.2 |
| 41 | CYLINDER | 50 | 1.5 | 85 | 110 | 25 | 2 LAYERS | 1.5 | 0 | 6 | 2 | 2 | 2.2 |
| 42 | CYLINDER | 50 | 1.5 | 85 | 110 | 25 | 2 LAYERS | 2 | 0 | 6 | 2 | 2 | 2.2 |
| 43 | CYLINDER | 50 | 1.5 | 85 | 110 | 25 | 2 LAYERS | 5 | 0 | 6 | 2 | 2 | 2.2 |
| 44 | CYLINDER | 50 | 1.5 | 85 | 110 | 25 | 2 LAYERS | 10 | 0 | 6 | 2 | 2 | 2.2 |
| 45 | CYLINDER | 50 | 1.5 | 85 | 110 | 25 | 2 LAYERS | 20 | 0 | 6 | 2 | 2 | 2.2 |
| 46 | CYLINDER | 50 | 1.5 | 85 | 110 | 25 | 2 LAYERS | 45 | 0 | 6 | 2 | 2 | 2.2 |
| 47 | CYLINDER | 50 | 1.5 | 85 | 110 | 25 | 2 LAYERS | 60 | 0 | 6 | 2 | 2 | 2.2 |
| 48 | CYLINDER | 50 | 1.5 | 85 | 110 | 25 | 2 LAYERS | 65 | 0 | 6 | 2 | 2 | 2.2 |
| 49 | CYLINDER | 50 | 1.5 | 85 | 110 | 25 | 1 LAYER | 20 | 0 | 6 | 2 | 2 | 2.2 |
| 50 | CYLINDER | 50 | 1.5 | 85 | 110 | 25 | TOTAL NUMBER OF LAYERS 1/4 | 20 | 0 | 6 | 2 | 2 | 2.2 |
| 51 | CYLINDER | 50 | 1.5 | 85 | 110 | 25 | TOTAL NUMBER OF LAYERS 1/3 | 20 | 0 | 6 | 2 | 2 | 2.2 |
| 52 | CYLINDER | 50 | 1.5 | 85 | 110 | 25 | TOTAL NUMBER OF LAYERS 2/5 | 20 | 0 | 6 | 2 | 2 | 2.2 |
| 53 | CYLINDER | 50 | 1.5 | 85 | 110 | 0 | 2 LAYERS | 20 | 0 | 6 | 2 | 2 | 2.2 |
| 54 | CYLINDER | 50 | 1.5 | 85 | 110 | 5 | 2 LAYERS | 20 | 0 | 6 | 2 | 2 | 2.2 |
| 55 | CYLINDER | 50 | 1.5 | 85 | 110 | 52 | 2 LAYERS | 20 | 0 | 6 | 2 | 2 | 2.2 |
| 56 | CYLINDER | 50 | 1.5 | 85 | 110 | 58 | 2 LAYERS | 20 | 0 | 6 | 2 | 2 | 2.2 |
| 57 | CYLINDER | 50 | 1.5 | 85 | 110 | 25 | 2 LAYERS | 20 | 0 | 0.5 | 2 | 2 | 2.2 |
| 58 | CYLINDER | 50 | 1.5 | 85 | 110 | 25 | 2 LAYERS | 20 | 0 | 1 | 2 | 2 | 2.2 |
| 59 | CYLINDER | 50 | 1.5 | 85 | 110 | 25 | 2 LAYERS | 20 | 0 | 6 | 2 | 2 | 2.2 |
| 60 | CYLINDER | 50 | 1.5 | 85 | 110 | 25 | 2 LAYERS | 20 | 0 | 10 | 2 | 2 | 2.2 |
| 61 | CYLINDER | 50 | 1.5 | 85 | 110 | 25 | 2 LAYERS | 20 | 0 | 20 | 2 | 2 | 2.2 |
| 62 | CYLINDER | 50 | 1.5 | 85 | 110 | 25 | 2 LAYERS | 20 | 0 | 50 | 2 | 2 | 2.2 |
| 63 | CYLINDER | 50 | 1.5 | 85 | 110 | 25 | 2 LAYERS | 20 | 0 | 0.5 | 2 | 2 | 2.2 |
| 64 | CYLINDER | 50 | 1.5 | 85 | 110 | 25 | 2 LAYERS | 20 | 0 | 1 | 2 | 2 | 2.2 |
| 65 | CYLINDER | 50 | 1.5 | 85 | 110 | 25 | 2 LAYERS | 20 | 0 | 5 | 2 | 2 | 2.2 |
| 66 | CYLINDER | 50 | 1.5 | 85 | 110 | 25 | 2 LAYERS | 20 | 0 | 6 | 2 | 2 | 2.2 |
| 67 | CYLINDER | 50 | 1.5 | 85 | 110 | 25 | 2 LAYERS | 20 | 0 | 10 | 2 | 2 | 2.2 |
| 68 | CYLINDER | 50 | 1.5 | 85 | 110 | 25 | 2 LAYERS | 20 | 0 | 20 | 2 | 2 | 2.2 |
| 69 | CYLINDER | 50 | 1.5 | 85 | 110 | 25 | 2 LAYERS | 20 | 0 | 50 | 2 | 2 | 2.2 |
| 70 | CYLINDER | 30 | 1.5 | 110 | 110 | 25 | 2 LAYERS | 20 | 0 | 6 | 0.5 | 2 | 2.2 |
| 71 | CYLINDER | 30 | 1.5 | 110 | 110 | 25 | 2 LAYERS | 20 | 0 | 6 | 0.1 | 2 | 2.2 |
| 72 | CYLINDER | 30 | 1.5 | 110 | 110 | 25 | 2 LAYERS | 20 | 0 | 6 | 0.04 | 2 | 2.2 |

| No. | IMPACT MITIGATING STRUCTURE NON-BRAZING SECTION T1 mm | IMPACT MITIGATING STRUCTURE NON-BRAZING SECTION T2 mm | IMPACT MITIGATING STRUCTURE NON-BRAZING SECTION T3 mm | IMPACT MITIGATING STRUCTURE NON-BRAZING SECTION T4 mm | CONDITION 1 | CONDITION 2 | CONDITION 3 | CONDITION 4 | DURABILITY TEST EVALUATION COLD AND HEAT | DURABILITY TEST EVALUATION IMPACT | REMARKS |
|---|---|---|---|---|---|---|---|---|---|---|---|
| 37 | 0 | 0 | 2 | 2.2 | B | B | A | D | B | D | COMPARATIVE EXAMPLE 11 |
| 38 | 0 | 0 | 2 | 2.2 | B | B | A | D | B | D | COMPARATIVE EXAMPLE 12 |
| 39 | 6 | 2 | 2 | 2.2 | B | B | A | D | B | D | COMPARATIVE EXAMPLE 13 |
| 40 | 0 | 0 | 2 | 2.2 | B | B | D | B | D | D | COMPARATIVE EXAMPLE 14 |

TABLE 2-continued

| | | | | | | | | | | | |
|---|---|---|---|---|---|---|---|---|---|---|---|
| 41 | 0 | 0 | 2 | 2.2 | B | B | D | B | C | D | COMPARATIVE EXAMPLE 15 |
| 42 | 0 | 0 | 2 | 2.2 | B | B | B | B | C | C | INVENTION EXAMPLE 27 |
| 43 | 0 | 0 | 2 | 2.2 | B | B | A | B | B | B | INVENTION EXAMPLE 28 |
| 44 | 0 | 0 | 2 | 2.2 | B | B | A | B | B | B | INVENTION EXAMPLE 29 |
| 45 | 0 | 0 | 2 | 2.2 | B | B | A | B | B | B | INVENTION EXAMPLE 30 |
| 46 | 0 | 0 | 2 | 2.2 | B | B | A | B | B | B | INVENTION EXAMPLE 31 |
| 47 | 0 | 0 | 2 | 2.2 | B | B | B | B | C | C | INVENTION EXAMPLE 32 |
| 48 | 0 | 0 | 2 | 2.2 | B | B | D | B | D | D | COMPARATIVE EXAMPLE 16 |
| 49 | 0 | 0 | 2 | 2.2 | B | D | A | B | D | D | COMPARATIVE EXAMPLE 17 |
| 50 | 0 | 0 | 2 | 2.2 | B | B | A | B | B | B | INVENTION EXAMPLE 33 |
| 51 | 0 | 0 | 2 | 2.2 | B | B | A | B | B | B | INVENTION EXAMPLE 34 |
| 52 | 0 | 0 | 2 | 2.2 | B | D | A | B | D | D | COMPARATIVE EXAMPLE 18 |
| 53 | 0 | 0 | 2 | 2.2 | D | B | A | B | D | D | COMPARATIVE EXAMPLE 19 |
| 54 | 0 | 0 | 2 | 2.2 | B | B | A | B | B | B | INVENTION EXAMPLE 35 |
| 55 | 0 | 0 | 2 | 2.2 | B | B | A | B | B | B | INVENTION EXAMPLE 36 |
| 56 | 0 | 0 | 2 | 2.2 | D | B | A | B | D | D | COMPARATIVE EXAMPLE 20 |
| 57 | 0 | 0 | 2 | 2.2 | B | B | A | B | B | B | INVENTION EXAMPLE 37 |
| 58 | 0 | 0 | 2 | 2.2 | B | B | A | B | B | B | INVENTION EXAMPLE 38 |
| 59 | 0 | 0 | 2 | 2.2 | B | B | A | B | B | B | INVENTION EXAMPLE 39 |
| 60 | 0 | 0 | 2 | 2.2 | B | B | A | B | B | B | INVENTION EXAMPLE 40 |
| 61 | 0 | 0 | 2 | 2.2 | B | B | A | B | B | B | INVENTION EXAMPLE 41 |
| 62 | 0 | 0 | 2 | 2.2 | B | B | A | B | B | C | INVENTION EXAMPLE 42 |
| 63 | 6 | 2 | 2 | 2.2 | B | B | A | B | B | B | INVENTION EXAMPLE 43 |
| 64 | 6 | 2 | 2 | 2.2 | B | B | A | B | B | B | INVENTION EXAMPLE 44 |
| 65 | 6 | 2 | 2 | 2.2 | B | B | A | B | B | B | INVENTION EXAMPLE 45 |
| 66 | 6 | 2 | 2 | 2.2 | B | B | A | B | B | B | INVENTION EXAMPLE 46 |
| 67 | 6 | 2 | 2 | 2.2 | B | B | A | B | B | B | INVENTION EXAMPLE 47 |
| 68 | 6 | 2 | 2 | 2.2 | B | B | A | B | B | B | INVENTION EXAMPLE 48 |
| 69 | 6 | 2 | 2 | 2.2 | B | B | A | B | B | C | INVENTION EXAMPLE 49 |
| 70 | 0 | 0 | 2 | 2.2 | B | B | A | B | B | B | INVENTION EXAMPLE 50 |
| 71 | 0 | 0 | 2 | 2.2 | B | B | A | B | B | B | INVENTION EXAMPLE 51 |
| 72 | 0 | 0 | 2 | 2.2 | B | B | A | B | B | C | INVENTION EXAMPLE 52 |

TABLE 3

| No. | SHAPE | FOIL THICKNESS μm | OUTER TUBE THICKNESS mm | HONEYCOMB BODY DIMENTION MAJOR AXIS mm | HONEYCOMB BODY DIMENTION MINOR AXIS mm | L mm | JOINING STRUCTURE X mm | JOINING STRUCTURE BRAZING SECTION OUTER CIRCUMFERENTIAL JOINING | HONEYCOMB BODY-OUTER TUBE JOINING POSITION P mm | HONEYCOMB BODY-OUTER TUBE JOINING POSITION FROM OUTPUT SIDE END SURFACE mm | IMPACT MITIGATING STRUCTURE BRAZING SECTION T1 mm | IMPACT MITIGATING STRUCTURE BRAZING SECTION T2 mm | IMPACT MITIGATING STRUCTURE BRAZING SECTION T3 mm | IMPACT MITIGATING STRUCTURE BRAZING SECTION T4 mm |
|---|---|---|---|---|---|---|---|---|---|---|---|---|---|---|
| 73 | RT | 40 | 2 | 140 | 65 | 90 | 15 | 2 LAYERS | 15 | 0 | 0 | 0 | 1.5 | 1.4 |
| 74 | RT | 40 | 2 | 140 | 85 | 90 | 15 | 2 LAYERS | 15 | 0 | 0 | 0 | 1.5 | 1.4 |
| 75 | RT | 40 | 2 | 140 | 85 | 90 | 15 | 2 LAYERS | 15 | 0 | 0 | 0 | 1.5 | 1.4 |
| 76 | RT | 40 | 2 | 140 | 55 | 90 | 15 | 2 LAYERS | 15 | 70 | 8 | 1.5 | 1.5 | 1.4 |
| 77 | RT | 40 | 2 | 140 | 85 | 90 | 15 | 2 LAYERS | 1.5 | 0 | 8 | 2 | 1.5 | 1.4 |
| 78 | RT | 40 | 2 | 140 | 65 | 90 | 15 | 2 LAYERS | 2 | 0 | 8 | 2 | 1.5 | 1.4 |
| 79 | RT | 40 | 2 | 140 | 65 | 90 | 15 | 2 LAYERS | 5 | 0 | 8 | 2 | 1.5 | 1.4 |
| 80 | RT | 40 | 2 | 140 | 85 | 90 | 15 | 2 LAYERS | 10 | 0 | 8 | 2 | 1.5 | 1.4 |
| 81 | RT | 40 | 2 | 140 | 85 | 90 | 15 | 2 LAYERS | 20 | 0 | 8 | 2 | 1.5 | 1.4 |
| 82 | RT | 40 | 2 | 140 | 55 | 90 | 15 | 2 LAYERS | 45 | 0 | 8 | 2 | 1.5 | 1.4 |
| 83 | RT | 40 | 2 | 140 | 65 | 90 | 15 | 2 LAYERS | 50 | 0 | 8 | 2 | 1.5 | 1.4 |
| 84 | RT | 40 | 2 | 140 | 85 | 90 | 15 | 2 LAYERS | 55 | 0 | 8 | 2 | 1.5 | 1.4 |
| 85 | RT | 40 | 2 | 140 | 55 | 90 | 15 | 1 LAYER | 15 | 0 | 8 | 2 | 1.5 | 1.4 |
| 86 | RT | 40 | 2 | 140 | 65 | 90 | 15 | TOTAL NUMBER OF LAYERS 1/4 | 15 | 0 | 8 | 2 | 1.5 | 1.4 |
| 87 | RT | 40 | 2 | 140 | 65 | 90 | 15 | TOTAL NUMBER OF LAYERS 1/3 | 15 | 0 | 8 | 2 | 1.5 | 1.4 |
| 88 | RT | 40 | 2 | 140 | 65 | 90 | 15 | TOTAL NUMBER OF LAYERS 2/5 | 15 | 0 | 8 | 2 | 1.5 | 1.4 |
| 89 | RT | 40 | 2 | 140 | 65 | 90 | 0 | 2 LAYERS | 15 | 0 | 8 | 2 | 1.5 | 1.4 |
| 90 | RT | 40 | 2 | 140 | 85 | 90 | 5 | 2 LAYERS | 15 | 0 | 8 | 2 | 1.5 | 1.4 |
| 91 | RT | 40 | 2 | 140 | 85 | 90 | 43 | 2 LAYERS | 15 | 0 | 8 | 2 | 1.5 | 1.4 |
| 92 | RT | 40 | 2 | 140 | 65 | 90 | 51 | 2 LAYERS | 15 | 0 | 8 | 2 | 1.5 | 1.4 |
| 93 | RT | 40 | 2 | 140 | 65 | 90 | 15 | 2 LAYERS | 15 | 0 | 0.5 | 2 | 1.5 | 1.4 |
| 94 | RT | 40 | 2 | 140 | 85 | 90 | 15 | 2 LAYERS | 15 | 0 | 1 | 2 | 1.5 | 1.4 |
| 95 | RT | 40 | 2 | 140 | 65 | 90 | 15 | 2 LAYERS | 15 | 0 | 5 | 2 | 1.5 | 1.4 |
| 96 | RT | 40 | 2 | 140 | 65 | 90 | 15 | 2 LAYERS | 15 | 0 | 10 | 2 | 1.5 | 1.4 |
| 97 | RT | 40 | 2 | 140 | 85 | 90 | 15 | 2 LAYERS | 15 | 0 | 20 | 2 | 1.5 | 1.4 |
| 98 | RT | 40 | 2 | 140 | 65 | 90 | 15 | 2 LAYERS | 15 | 0 | 50 | 2 | 1.5 | 1.4 |
| 99 | RT | 40 | 2 | 140 | 65 | 90 | 15 | 2 LAYERS | 15 | 0 | 0.5 | 2 | 1.5 | 1.4 |
| 100 | RT | 40 | 2 | 140 | 85 | 90 | 15 | 2 LAYERS | 15 | 0 | 1 | 2 | 1.5 | 1.4 |
| 101 | RT | 40 | 2 | 140 | 65 | 90 | 15 | 2 LAYERS | 15 | 0 | 5 | 2 | 1.5 | 1.4 |
| 102 | RT | 40 | 2 | 140 | 85 | 90 | 15 | 2 LAYERS | 15 | 0 | 8 | 2 | 1.5 | 1.4 |
| 103 | RT | 40 | 2 | 140 | 85 | 90 | 15 | 2 LAYERS | 15 | 0 | 10 | 2 | 1.5 | 1.4 |
| 104 | RT | 40 | 2 | 140 | 85 | 90 | 15 | 2 LAYERS | 15 | 0 | 20 | 2 | 1.5 | 1.4 |
| 105 | RT | 40 | 2 | 140 | 65 | 90 | 15 | 2 LAYERS | 15 | 0 | 50 | 2 | 1.5 | 1.4 |
| 106 | CYLINDER | 40 | 2 | 140 | 85 | 90 | 15 | 2 LAYERS | 15 | 0 | 8 | 0.5 | 1.5 | 1.4 |
| 107 | CYLINDER | 40 | 2 | 140 | 85 | 90 | 15 | 2 LAYERS | 15 | 0 | 8 | 0.1 | 1.5 | 1.4 |
| 108 | CYLINDER | 40 | 2 | 140 | 65 | 90 | 15 | 2 LAYERS | 15 | 0 | 8 | 0.04 | 1.5 | 1.4 |

| No. | IMPACT MITIGATING STRUCTURE NON-BRAZING SECTION T1 mm | T2 mm | T3 mm | T4 mm | CONDITION 1 | CONDITION 2 | CONDITION 3 | CONDITION 4 | DURABILITY TEST EVALUATION COLD AND HEAT | IMPACT | REMARKS |
|---|---|---|---|---|---|---|---|---|---|---|---|
| 73 | 0 | 0 | 1.5 | 1.4 | B | B | A | D | B | D | COMPARATIVE EXAMPLE 21 |
| 74 | 0 | 0 | 1.5 | 1.4 | B | B | A | D | B | D | COMPARATIVE EXAMPLE 22 |
| 75 | 6 | 2 | 1.5 | 1.4 | B | B | A | D | B | D | COMPARATIVE EXAMPLE 23 |
| 76 | 0 | 0 | 1.5 | 1.4 | B | B | D | B | D | D | COMPARATIVE EXAMPLE 24 |

TABLE 3-continued

| | | | | | | | | | | | |
|---|---|---|---|---|---|---|---|---|---|---|---|
| 77 | 0 | 0 | 1.5 | 1.4 | B | B | D | B | C | D | COMPARATIVE EXAMPLE 25 |
| 78 | 0 | 0 | 1.5 | 1.4 | B | B | B | B | C | C | INVENTION EXAMPLE 53 |
| 79 | 0 | 0 | 1.5 | 1.4 | B | B | A | B | B | B | INVENTION EXAMPLE 54 |
| 80 | 0 | 0 | 1.5 | 1.4 | B | B | A | B | B | B | INVENTION EXAMPLE 55 |
| 81 | 0 | 0 | 1.5 | 1.4 | B | B | A | B | B | B | INVENTION EXAMPLE 56 |
| 82 | 0 | 0 | 1.5 | 1.4 | B | B | A | B | B | B | INVENTION EXAMPLE 57 |
| 83 | 0 | 0 | 1.5 | 1.4 | B | B | B | B | C | C | INVENTION EXAMPLE 58 |
| 84 | 0 | 0 | 1.5 | 1.4 | B | B | D | B | D | D | COMPARATIVE EXAMPLE 26 |
| 85 | 0 | 0 | 1.5 | 1.4 | B | D | A | B | D | D | COMPARATIVE EXAMPLE 27 |
| 86 | 0 | 0 | 1.5 | 1.4 | B | B | A | B | B | B | INVENTION EXAMPLE 59 |
| 87 | 0 | 0 | 1.5 | 1.4 | B | B | A | B | B | B | INVENTION EXAMPLE 60 |
| 88 | 0 | 0 | 1.5 | 1.4 | B | D | A | B | D | D | COMPARATIVE EXAMPLE 28 |
| 89 | 0 | 0 | 1.5 | 1.4 | B | B | A | B | D | D | COMPARATIVE EXAMPLE 29 |
| 90 | 0 | 0 | 1.5 | 1.4 | B | B | A | B | B | B | INVENTION EXAMPLE 61 |
| 91 | 0 | 0 | 1.5 | 1.4 | B | B | A | B | B | B | INVENTION EXAMPLE 62 |
| 92 | 0 | 0 | 1.5 | 1.4 | B | B | A | B | D | D | COMPARATIVE EXAMPLE 30 |
| 93 | 0 | 0 | 1.5 | 1.4 | B | B | A | B | B | B | INVENTION EXAMPLE 63 |
| 94 | 0 | 0 | 1.5 | 1.4 | B | B | A | B | B | B | INVENTION EXAMPLE 64 |
| 95 | 0 | 0 | 1.5 | 1.4 | B | B | A | B | B | B | INVENTION EXAMPLE 65 |
| 96 | 0 | 0 | 1.5 | 1.4 | B | B | A | B | B | B | INVENTION EXAMPLE 66 |
| 97 | 0 | 0 | 1.5 | 1.4 | B | B | A | B | B | B | INVENTION EXAMPLE 67 |
| 98 | 0 | 0 | 1.5 | 1.4 | B | B | A | B | B | C | INVENTION EXAMPLE 68 |
| 99 | 8 | 2 | 1.5 | 1.4 | B | B | A | B | B | B | INVENTION EXAMPLE 69 |
| 100 | 6 | 2 | 1.5 | 1.4 | B | B | A | B | B | B | INVENTION EXAMPLE 70 |
| 101 | 8 | 2 | 1.5 | 1.4 | B | B | A | B | B | B | INVENTION EXAMPLE 71 |
| 102 | 8 | 2 | 1.5 | 1.4 | B | B | A | B | B | B | INVENTION EXAMPLE 72 |
| 103 | 6 | 2 | 1.5 | 1.4 | B | B | A | B | B | B | INVENTION EXAMPLE 73 |
| 104 | 6 | 2 | 1.5 | 1.4 | B | B | A | B | B | B | INVENTION EXAMPLE 74 |
| 105 | 8 | 2 | 1.5 | 1.4 | B | B | A | B | B | C | INVENTION EXAMPLE 75 |
| 106 | 0 | 0 | 1.5 | 1.4 | B | B | A | B | B | B | INVENTION EXAMPLE 76 |
| 107 | 0 | 0 | 1.5 | 1.4 | B | B | A | B | B | B | INVENTION EXAMPLE 77 |
| 108 | 0 | 0 | 1.5 | 1.4 | B | B | A | B | B | C | INVENTION EXAMPLE 78 |

Durability against cold and heat was evaluated by allowing hot air and cold air to alternately flow into the metal substrate for catalytic converter so that the metal substrate for catalytic converter is repeatedly cooled and heated. Such repeated cooling and heating causes the joining section between the outer jacket and the honeycomb core to rupture, which leads to, for example, dropping off of the honeycomb core. The frequency of repeated cooling and heating before the honeycomb core drops off was counted. When the counted number was 600 or more, durability against cold and heat was very good and evaluated as "B". When the counted number was 400 to 600, durability against cold and heat was good and evaluated as "C". When the counted number was less than 400, durability against cold and heat was failure and evaluated as "D". It is noted that the cooling and heating treatment included a temperature rising treatment for increasing the temperature to 950° C., a temperature maintaining treatment for maintaining the temperature at 950° C., and a cooling treatment for cooling to 150° C. or lower. In the temperature rising treatment, the set temperature rising time was one minute, and the set maximum heating rate was 120° C./second. In the temperature maintaining treatment, the set temperature maintaining time was four minutes. In the cooling treatment, the set cooling temperature was 150° C. or lower, the set cooling time was 2.5 minutes, and the set minimum cooling rate was −40° C./second.

A test for durability against impact was performed following to the test for durability against cold and heat. The soundness of the joining section between the outer jacket and the honeycomb core was evaluated by changing the temperature in the same manner as in the test for durability against cold and heat while applying, to the metal substrate for catalytic converter, vibration with an acceleration of 100 G (a 45° direction with respect to the axial direction of the metal substrate) at a frequency of 200 Hz. Evaluation was performed in a similar manner to the test for durability against cold and heat by counting the frequency of repeated cooling and heating before the honeycomb core drops off. When the counted number was 600 or more, durability against impact was very good and evaluated as "B". When the counted number was 400 to 600, durability against impact was good and evaluated as "C". When the counted number was less than 400, durability against impact was failure and evaluated as "D".

In Tables 1 to 3, "foil thickness" means the total thickness of two layers of a flat metal foil and a corrugated metal foil superimposed onto each other. In the honeycomb core having a cylindrical shape, "R" indicates the diameter of the honeycomb core, and "L" indicates the length in the axial direction of the honeycomb core. In the honeycomb core having an RT shape, the major axis and minor axis are as illustrated in FIG. 8, and "L" indicates the length in the axial direction. Condition 1 corresponds to "the gas inlet side joining section extends 5 mm or more and 50% or less of an entire length in an axial direction from a gas inlet side end section of the honeycomb core, across all layers in a radial direction of the honeycomb core" described in claim 1. When the condition 1 was fulfilled, a rating of "B" was assigned. When the condition 1 was not fulfilled, a rating of "D" was assigned. Condition 2 corresponds to "the outer circumferential joining section extends from the axial end section of the gas inlet side joining section toward a gas outlet side end section of the honeycomb core across two or more layers and ⅓ or less of the total number of layers in the radial direction from an outermost circumference of the honeycomb core" described in claim 1. When the condition 2 was fulfilled, a rating of "B" was assigned. When the condition 2 was not fulfilled, a rating of "D" was assigned. Condition 3 corresponds to "2 mm≤P≤50 mm" described in claim 1. When "5 mm≤P≤45 mm" (that is, a numerical value condition described in claim 2) was fulfilled, a rating of "A" was assigned. When "2 mm≤P<5 mm" or "45 mm<P≤50 mm" was fulfilled, a rating of "B" was assigned. When both of these conditions were not fulfilled, a rating of "D" was assigned. Furthermore, when the joining layer was not formed in the gas outlet side end section of the honeycomb core, a rating of "D" was also assigned. Condition 4 corresponds to "includes an impact mitigating section having different wave phases between the front and rear in the axial direction" described in claim 1. When the wave phases were different (that is, T2>0), a rating of "B" was assigned. When the wave phases were the same (that is, T2=0), a rating of "D" was assigned. In brief, when an offset structure was provided, a rating of "B" was assigned, and when an offset structure was not provided, a rating of "D" was assigned.

In Comparative examples 1 to 3, 11 to 13, and 21 to 23, the conditions 1 to 3 were fulfilled, resulting in a rating of "B" for durability against cold and heat, but the condition 4 was not fulfilled (that is, an offset structure was not provided), resulting in a rating of "D" for durability against impact. In Comparative examples 4, 14, and 24, the condition 3 was not fulfilled, that is, the joining layer was formed at a position spaced apart from the gas outlet side end section of the honeycomb core, resulting in a rating of "D" for durability against cold and heat. In Comparative examples 5, 15, and 25, the condition 3 was not fulfilled, that is, the length P in the axial direction of the joining layer was too short, resulting in a rating of "C" for durability against cold and heat and a rating of "D" for durability against impact. In Comparative examples 6, 16, and 26, the condition 3 was not fulfilled, that is, the length P in the axial direction of the joining layer was too long, resulting in a rating of "D" for durability against cold and heat. In Comparative examples 7, 17, and 27, the condition 2 was not fulfilled, that is, the number of layers in the outer circumferential joining section was too small, resulting in a rating of "D" for both durability against cold and heat and durability against impact. In Comparative examples 8, 18, and 28, the condition 2 was not fulfilled, that is, the number of layers in the outer circumferential joining section exceeded ⅓ of the total number of layers, resulting in a rating of "D" for both durability against cold and heat and durability against impact. In Comparative examples 9, 19, and 29, the condition 1 was not fulfilled, that is, the gas inlet side joining section was not provided, resulting in a rating of "D" for both durability against cold and heat and durability against impact. In Comparative examples 10, 20, and 30, the condition 1 was not fulfilled, that is, the gas inlet side joining section exceeded 50% of the entire length in the axial direction of the honeycomb core, resulting in a rating of "D" for both durability against cold and heat and durability against impact.

Example 2

Example 2 corresponds to the second embodiment. The effect of the present invention was examined by preparing a metal substrate for catalytic converter having a cylindrical shape or an RT shape according to various specifications, and then evaluating purification performance and pressure loss of the prepared metal substrate for catalytic converter. A catalyst was carried by the following method. On a prototype metal substrate, a wash coat layer including ceria-zirconia-alumina as a main component was formed. A wash coat liquid was allowed to flow on the metal substrate, and an excess wash coat liquid was removed. Then, the resultant product was dried at 180° C. for one hour, and subsequently calcined at 500° C. for two hours. Accordingly, a wash coat layer was formed on the metal substrate in an amount of 180 g/L per volume of the substrate. The metal carrier with this wash coat layer formed thereon was immersed in distilled water to sufficiently absorb water. Thereafter, the metal carrier was pulled up, and excess moisture was blown off. Then, the metal carrier was immersed in an aqueous solution containing palladium. The metal carrier was taken out and dried. Thus, palladium was carried in an amount of 4 g/L per volume of the substrate.

The obtained metal substrate for catalytic converter was placed in a catalyst container, and evaluated for purification performance and pressure loss by the following method. At this time, the metal substrate for catalytic converter was previously exposed to an ambient atmosphere in which the air containing water vapor in a ratio of 10% was heated to 980° C. Then, the metal substrate for catalytic converter was retained for four hours, and subjected to a deterioration simulation treatment. Each metal substrate for catalytic converter was evaluated for purification performance with a model exhaust gas containing CO, HC, and NOx. The condition of this model exhaust gas was a stoichiometric component. Changes in purification rate during a temperature rising process were measured by heating a model exhaust gas with a heater in the stage previous to a gas inlet side while allowing the model exhaust gas to flow into each metal substrate for catalytic converter at a flow rate of SV=100,000 $h^{-1}$. Gas components on the gas inlet side and the gas outlet side were analyzed, and a decrease rate thereof was used as a purification rate. Input gas temperature T50 at which the purification rate has become 50% during the temperature rising process was defined to bean evaluation value. In the present example, T50 of an HC component was defined to be an evaluation value. In evaluation of pressure loss, $N_2$ gas at room temperature was allowed to flow into the metal substrate for catalytic converter, and pressure loss generated in the metal substrate for catalytic converter at this time was measured by a pitot-tube method. The flow rate of $N_2$ gas was 905 L/min in Table 4, 540 L/min in Table 5, and 780 L/min in Table 6.

Table 4 to Table 6 show various specifications and evaluation results thereof. The metal substrate for catalytic converter was according to the following specification. The honeycomb core in Table 4 had a shape of a cylinder, a foil thickness of 30 μm, a diameter of 110 mm, and a length in an axial direction of 98 mm. The outer jacket in Table 4 had a thickness of 1.5 mm. In Table 4, the length (that is, X) of the gas inlet side joining section was 25 mm, and the number of layers for outer circumferential joining was three. P as a length of the outer circumferential joining of the honeycomb core in Table 4 was 20 mm, and a position from the gas outlet side end surface was 0 mm. The honeycomb core in Table 5 had a shape of a cylinder, a foil thickness of 50 μm, a diameter of 85 mm, and a length in an axial direction of 110 mm. The outer jacket in Table had a thickness of 1.5 mm. In Table 5, the length (that is, X) of the gas inlet side joining section was 20 mm, and the number of layers for outer circumferential joining was three. P as a length of outer circumferential joining of the honeycomb core in Table was 25 mm, and a position from the gas outlet side end surface was 0 mm. The honeycomb core in Table 6 had a shape of RT, a foil thickness of 40 μm, a diameter of 140 mm, a length in an axial direction of 90 mm, a major axis of 140 mm, and a minor axis of 65 mm. The outer jacket in Table 6 had a thickness of 2.0 mm. In Table 6, the length (that is, X) of the gas inlet side joining section was 15 mm, and the number of layers for outer circumferential joining was two. P as a length of outer circumferential joining of the honeycomb core in Table 6 was 15 mm, and a position from the gas outlet side end surface was 0 mm.

TABLE 4

| | IMPACT MITIGATING STRUCTURE | | | | | | | | | | | | | |
|---|---|---|---|---|---|---|---|---|---|---|---|---|---|---|
| | BRAZING SECTION | | | | | | NON-BRAZING SECTION | | | | | | | |
| No | H (mm) | O (mm) | H/O | α (degree) | S1/S2 | I (mm) | H (mm) | O (mm) | H/O | α (degree) | S1/S2 | I (mm) | CONDI-TION 1 | CONDI-TION 2 |
| 109 | 1.79 | 2.24 | 0.8 | 5 | 1 | 4 | 1.79 | 2.24 | 0.8 | 5 | 0 | — | B | B |
| 110 | 1.34 | 1.68 | 0.8 | 5 | 1 | 3 | 1.34 | 1.68 | 0.8 | 5 | 0 | — | B | B |
| 111 | 1.12 | 1.40 | 0.8 | 5 | 1 | 2.5 | 1.12 | 1.40 | 0.8 | 5 | 0 | — | B | B |
| 112 | 0.89 | 1.12 | 0.8 | 5 | 1 | 2 | 0.89 | 1.12 | 0.8 | 5 | 0 | — | B | B |
| 113 | 1.79 | 2.24 | 0.8 | 5 | 1.2 | 4 | 1.79 | 2.24 | 0.8 | 5 | 0 | — | B | B |
| 114 | 1.34 | 1.68 | 0.8 | 5 | 1.2 | 3 | 1.34 | 1.68 | 0.8 | 5 | 0 | — | B | B |
| 115 | 1.12 | 1.40 | 0.8 | 5 | 1.2 | 2.5 | 1.12 | 1.40 | 0.8 | 5 | 0 | — | B | B |
| 116 | 0.80 | 1.12 | 0.8 | 5 | 1.2 | 2 | 0.80 | 1.12 | 0.8 | 5 | 0 | — | B | B |
| 117 | 1.79 | 2.24 | 0.8 | 5 | 4 | 4 | 1.79 | 2.24 | 0.8 | 5 | 0 | — | B | B |
| 118 | 1.34 | 1.68 | 0.8 | 5 | 4 | 3 | 1.34 | 1.68 | 0.8 | 5 | 0 | — | B | B |
| 119 | 1.12 | 1.40 | 0.8 | 5 | 4 | 2.5 | 1.12 | 1.40 | 0.8 | 5 | 0 | — | B | B |
| 120 | 0.89 | 1.12 | 0.8 | 5 | 4 | 2 | 0.89 | 1.12 | 0.8 | 5 | 0 | — | B | B |
| 121 | 1.79 | 2.24 | 0.8 | 5 | 10 | 4 | 1.79 | 2.24 | 0.8 | 5 | 0 | — | B | B |
| 122 | 1.34 | 1.68 | 0.8 | 5 | 10 | 3 | 1.34 | 1.68 | 0.8 | 5 | 0 | — | B | B |
| 123 | 1.12 | 1.40 | 0.8 | 5 | 10 | 2.5 | 1.12 | 1.40 | 0.8 | 5 | 0 | — | B | B |
| 124 | 0.89 | 1.12 | 0.8 | 5 | 10 | 2 | 0.89 | 1.12 | 0.8 | 5 | 0 | — | B | B |
| 125 | 1.79 | 2.24 | 0.8 | 5 | 12 | 4 | 1.79 | 2.24 | 0.8 | 5 | 0 | — | B | B |
| 126 | 1.34 | 1.68 | 0.8 | 5 | 12 | 3 | 1.34 | 1.68 | 0.8 | 5 | 0 | — | B | B |
| 127 | 1.12 | 1.40 | 0.8 | 5 | 12 | 2.5 | 1.12 | 1.40 | 0.8 | 5 | 0 | — | B | B |
| 128 | 0.89 | 1.12 | 0.8 | 5 | 12 | 2 | 0.89 | 1.12 | 0.8 | 5 | 0 | — | B | B |
| 129 | 1.79 | 2.24 | 0.8 | 5 | 1 | 4 | 1.79 | 2.24 | 0.8 | 5 | 1 | 4 | B | B |
| 130 | 1.34 | 1.68 | 0.8 | 5 | 1 | 3 | 1.34 | 1.68 | 0.8 | 5 | 1 | 3 | B | B |
| 131 | 1.12 | 1.40 | 0.8 | 5 | 1 | 2.5 | 1.12 | 1.40 | 0.8 | 5 | 1 | 2.5 | B | B |
| 132 | 0.89 | 1.12 | 0.8 | 5 | 1 | 2 | 0.89 | 1.12 | 0.8 | 5 | 1 | 2 | B | B |
| 133 | 1.79 | 2.24 | 0.8 | 5 | 1.2 | 4 | 1.79 | 2.24 | 0.8 | 5 | 1.2 | 4 | B | B |
| 134 | 1.34 | 1.68 | 0.8 | 5 | 1.2 | 3 | 1.34 | 1.68 | 0.8 | 5 | 1.2 | 3 | B | B |
| 135 | 1.12 | 1.40 | 0.8 | 5 | 1.2 | 2.5 | 1.12 | 1.40 | 0.8 | 5 | 1.2 | 2.5 | B | B |
| 136 | 0.89 | 1.12 | 0.8 | 5 | 1.2 | 2 | 0.89 | 1.12 | 0.8 | 5 | 1.2 | 2 | B | B |
| 137 | 1.79 | 2.24 | 0.8 | 5 | 4 | 4 | 1.79 | 2.24 | 0.8 | 5 | 4 | 4 | B | B |
| 138 | 1.34 | 1.68 | 0.8 | 5 | 4 | 3 | 1.34 | 1.68 | 0.8 | 5 | 4 | 3 | B | B |
| 139 | 1.12 | 1.40 | 0.8 | 5 | 4 | 2.5 | 1.12 | 1.40 | 0.8 | 5 | 4 | 2.5 | B | B |
| 140 | 0.89 | 1.12 | 0.8 | 5 | 4 | 2 | 0.89 | 1.12 | 0.8 | 5 | 4 | 2 | B | B |
| 141 | 1.79 | 2.24 | 0.8 | 5 | 10 | 4 | 1.79 | 2.24 | 0.8 | 5 | 8 | 4 | B | B |
| 142 | 1.34 | 1.68 | 0.8 | 5 | 10 | 3 | 1.34 | 1.68 | 0.8 | 5 | 8 | 3 | B | B |
| 143 | 1.12 | 1.40 | 0.8 | 5 | 10 | 2.5 | 1.12 | 1.40 | 0.8 | 5 | 8 | 2.5 | B | B |
| 144 | 0.89 | 1.12 | 0.8 | 5 | 10 | 2 | 0.89 | 1.12 | 0.8 | 5 | 8 | 2 | B | B |
| 145 | 1.79 | 2.24 | 0.8 | 5 | 12 | 4 | 1.79 | 2.24 | 0.8 | 5 | 12 | 4 | B | B |
| 146 | 1.34 | 1.68 | 0.8 | 5 | 12 | 3 | 1.34 | 1.68 | 0.8 | 5 | 12 | 3 | B | B |
| 147 | 1.12 | 1.40 | 0.8 | 5 | 12 | 2.5 | 1.12 | 1.40 | 0.8 | 5 | 12 | 2.5 | B | B |
| 148 | 0.89 | 1.12 | 0.8 | 5 | 12 | 2 | 0.89 | 1.12 | 0.8 | 5 | 12 | 2 | B | B |

TABLE 4-continued

| No | CONDI-TION 3 | CONDI-TION 4 | DURABILITY TEST EVALUATION COLD AND HEAT | IMPACT | EVALUATION VALUE T50 (degree) | PRESSURE LOSS (Pa) | REMARKS |
|---|---|---|---|---|---|---|---|
| 109 | A | B | B | B | 311.5 | 50 | INVENTION EXAMPLE 79 |
| 110 | A | B | B | B | 303.4 | 88 | INVENTION EXAMPLE 80 |
| 111 | A | B | B | B | 298.3 | 125 | INVENTION EXAMPLE 81 |
| 112 | A | B | B | B | 294.1 | 199 | INVENTION EXAMPLE 82 |
| 113 | A | B | B | B | 308 | 50 | INVENTION EXAMPLE 83 |
| 114 | A | B | B | B | 299.5 | 88 | INVENTION EXAMPLE 84 |
| 115 | A | B | B | B | 295 | 125 | INVENTION EXAMPLE 85 |
| 116 | A | B | B | B | 201.6 | 190 | INVENTION EXAMPLE 86 |
| 117 | A | B | B | B | 306.9 | 50 | INVENTION EXAMPLE 87 |
| 118 | A | B | B | B | 298.7 | 88 | INVENTION EXAMPLE 88 |
| 119 | A | B | B | B | 294.1 | 125 | INVENTION EXAMPLE 89 |
| 120 | A | B | B | B | 290.5 | 199 | INVENTION EXAMPLE 90 |
| 121 | A | B | B | B | 308 | 52 | INVENTION EXAMPLE 91 |
| 122 | A | B | B | B | 299.3 | 93 | INVENTION EXAMPLE 92 |
| 123 | A | B | B | B | 295.1 | 131 | INVENTION EXAMPLE 93 |
| 124 | A | B | B | B | 291.4 | 209 | INVENTION EXAMPLE 94 |
| 125 | A | B | B | B | 310.3 | 55 | INVENTION EXAMPLE 95 |
| 126 | A | B | B | B | 301.4 | 99 | INVENTION EXAMPLE 96 |
| 127 | A | B | B | B | 297.2 | 136 | INVENTION EXAMPLE 97 |
| 128 | A | B | B | B | 293.5 | 223 | INVENTION EXAMPLE 98 |
| 129 | A | B | B | B | 311.2 | 61 | INVENTION EXAMPLE 99 |
| 130 | A | B | B | B | 303.1 | 89 | INVENTION EXAMPLE 100 |
| 131 | A | B | B | B | 297.9 | 126 | INVENTION EXAMPLE 101 |
| 132 | A | B | B | B | 293.7 | 200 | INVENTION EXAMPLE 102 |
| 133 | A | B | B | B | 307.6 | 51 | INVENTION EXAMPLE 103 |
| 134 | A | B | B | B | 299.1 | 89 | INVENTION EXAMPLE 104 |
| 135 | A | B | B | B | 294.6 | 128 | INVENTION EXAMPLE 105 |
| 136 | A | B | B | B | 291.2 | 200 | INVENTION EXAMPLE 106 |
| 137 | A | B | B | B | 305.6 | 51 | INVENTION EXAMPLE 107 |
| 138 | A | B | B | B | 298.3 | 89 | INVENTION EXAMPLE 108 |
| 139 | A | B | B | B | 293.7 | 126 | INVENTION EXAMPLE 109 |
| 140 | A | B | B | B | 290.1 | 200 | INVENTION EXAMPLE 110 |
| 141 | A | B | B | B | 307.5 | 53 | INVENTION EXAMPLE 111 |
| 142 | A | B | B | B | 299 | 94 | INVENTION EXAMPLE 112 |
| 143 | A | B | B | B | 294.7 | 132 | INVENTION EXAMPLE 113 |

TABLE 4-continued

| | | | | | | | |
|---|---|---|---|---|---|---|---|
| 144 | A | B | B | B | 291 | 210 | INVENTION EXAMPLE 114 |
| 145 | A | B | B | B | 309.8 | 56 | INVENTION EXAMPLE 115 |
| 146 | A | B | B | B | 301.1 | 99 | INVENTION EXAMPLE 116 |
| 147 | A | B | B | B | 296.8 | 137 | INVENTION EXAMPLE 117 |
| 148 | A | B | B | B | 293.1 | 224 | INVENTION EXAMPLE 118 |

TABLE 5

| | IMPACT MITIGATING STRUCTURE | | | | | | | | | | | | | |
|---|---|---|---|---|---|---|---|---|---|---|---|---|---|---|
| | BRAZING SECTION | | | | | | NON-BRAZING SECTION | | | | | | | |
| No. | H (mm) | O (mm) | H/O | α (degree) | S1/S2 | I (mm) | H (mm) | O (mm) | H/O | α (degree) | S1/S2 | I (mm) | CONDITION 1 | CONDITION 2 |
| 149 | 1.26 | 3.16 | 0.4 | 45 | 1 | 4 | 1.26 | 3.18 | 0.4 | 45 | 0 | — | B | B |
| 150 | 0.95 | 2.37 | 0.4 | 45 | 1 | 3 | 0.95 | 2.37 | 0.4 | 45 | 0 | — | B | B |
| 151 | 0.79 | 1.98 | 0.4 | 45 | 1 | 2.5 | 0.79 | 1.98 | 0.4 | 45 | 0 | — | B | B |
| 152 | 0.63 | 1.58 | 0.4 | 45 | 1 | 2 | 0.63 | 1.58 | 0.4 | 45 | 0 | — | B | B |
| 153 | 1.26 | 3.16 | 0.4 | 45 | 1.2 | 4 | 1.26 | 3.16 | 0.4 | 45 | 0 | — | B | B |
| 154 | 0.95 | 2.37 | 0.4 | 45 | 1.2 | 3 | 0.95 | 2.37 | 0.4 | 45 | 0 | — | B | B |
| 155 | 0.79 | 1.98 | 0.4 | 45 | 1.2 | 2.5 | 0.79 | 1.98 | 0.4 | 45 | 0 | — | B | B |
| 156 | 0.63 | 1.58 | 0.4 | 45 | 1.2 | 2 | 0.63 | 1.58 | 0.4 | 45 | 0 | — | B | B |
| 157 | 1.26 | 3.16 | 0.4 | 45 | 4 | 4 | 1.26 | 3.18 | 0.4 | 45 | 0 | — | B | B |
| 158 | 0.95 | 2.37 | 0.4 | 45 | 4 | 3 | 0.95 | 2.37 | 0.4 | 45 | 0 | — | B | B |
| 159 | 0.79 | 1.98 | 0.4 | 45 | 4 | 2.5 | 0.79 | 1.98 | 0.4 | 45 | 0 | — | B | B |
| 160 | 0.63 | 1.58 | 0.4 | 45 | 4 | 2 | 0.63 | 1.58 | 0.4 | 45 | 0 | — | B | B |
| 161 | 1.26 | 3.16 | 0.4 | 45 | 10 | 4 | 1.26 | 3.16 | 0.4 | 45 | 0 | — | B | B |
| 162 | 0.95 | 2.37 | 0.4 | 45 | 10 | 3 | 0.95 | 2.37 | 0.4 | 45 | 0 | — | B | B |
| 163 | 0.79 | 1.98 | 0.4 | 45 | 10 | 2.5 | 0.79 | 1.98 | 0.4 | 45 | 0 | — | B | B |
| 164 | 0.63 | 1.58 | 0.4 | 45 | 10 | 2 | 0.63 | 1.58 | 0.4 | 45 | 0 | — | B | B |
| 165 | 1.26 | 3.16 | 0.4 | 45 | 12 | 4 | 1.26 | 3.18 | 0.4 | 45 | 0 | — | B | B |
| 166 | 0.95 | 2.37 | 0.4 | 45 | 12 | 3 | 0.95 | 2.37 | 0.4 | 45 | 0 | — | B | B |
| 167 | 0.79 | 1.98 | 0.4 | 45 | 12 | 2.5 | 0.79 | 1.98 | 0.4 | 45 | 0 | — | B | B |
| 168 | 0.63 | 1.58 | 0.4 | 45 | 12 | 2 | 0.63 | 1.58 | 0.4 | 45 | 0 | — | B | B |
| 169 | 1.26 | 3.16 | 0.4 | 45 | 1 | 4 | 1.26 | 3.16 | 0.4 | 45 | 1 | 4 | B | B |
| 170 | 0.95 | 2.37 | 0.4 | 45 | 1 | 3 | 0.95 | 2.37 | 0.4 | 45 | 1 | 3 | B | B |
| 171 | 0.79 | 1.98 | 0.4 | 45 | 1 | 2.5 | 0.79 | 1.98 | 0.4 | 45 | 1 | 2.5 | B | B |
| 172 | 0.63 | 1.58 | 0.4 | 45 | 1 | 2 | 0.63 | 1.58 | 0.4 | 45 | 1 | 2 | B | B |
| 173 | 1.26 | 3.16 | 0.4 | 45 | 1.2 | 4 | 1.26 | 3.18 | 0.4 | 45 | 1.2 | 4 | B | B |
| 174 | 0.95 | 2.37 | 0.4 | 45 | 1.2 | 3 | 0.95 | 2.37 | 0.4 | 45 | 1.2 | 3 | B | B |
| 175 | 0.79 | 1.98 | 0.4 | 45 | 1.2 | 2.5 | 0.79 | 1.98 | 0.4 | 45 | 1.2 | 2.5 | B | B |
| 176 | 0.63 | 1.58 | 0.4 | 45 | 1.2 | 2 | 0.63 | 1.58 | 0.4 | 45 | 1.2 | 2 | B | B |
| 177 | 1.26 | 3.16 | 0.4 | 45 | 4 | 4 | 1.26 | 3.18 | 0.4 | 45 | 4 | 4 | B | B |
| 178 | 0.95 | 2.37 | 0.4 | 45 | 4 | 3 | 0.95 | 2.37 | 0.4 | 45 | 4 | 3 | B | B |
| 179 | 0.79 | 1.98 | 0.4 | 45 | 4 | 2.5 | 0.79 | 1.95 | 0.4 | 45 | 4 | 2.5 | B | B |
| 180 | 0.63 | 1.58 | 0.4 | 45 | 4 | 2 | 0.63 | 1.58 | 0.4 | 45 | 4 | 2 | B | B |
| 181 | 1.26 | 3.16 | 0.4 | 45 | 10 | 4 | 1.26 | 3.16 | 0.4 | 45 | 10 | 4 | B | B |
| 182 | 0.95 | 2.37 | 0.4 | 45 | 10 | 3 | 0.95 | 2.37 | 0.4 | 45 | 10 | 3 | B | B |
| 183 | 0.79 | 1.98 | 0.4 | 45 | 10 | 2.5 | 0.79 | 1.98 | 0.4 | 45 | 10 | 2.5 | B | B |
| 184 | 0.63 | 1.58 | 0.4 | 45 | 10 | 2 | 0.63 | 1.58 | 0.4 | 45 | 10 | 2 | B | B |
| 185 | 1.26 | 3.16 | 0.4 | 45 | 12 | 4 | 1.26 | 3.16 | 0.4 | 45 | 12 | 4 | B | B |
| 186 | 0.95 | 2.37 | 0.4 | 45 | 12 | 3 | 0.95 | 2.37 | 0.4 | 45 | 12 | 3 | B | B |
| 187 | 0.79 | 1.98 | 0.4 | 45 | 12 | 2.5 | 0.79 | 1.98 | 0.4 | 45 | 12 | 2.5 | B | B |
| 188 | 0.63 | 1.58 | 0.4 | 45 | 12 | 2 | 0.63 | 1.58 | 0.4 | 45 | 12 | 2 | B | B |

| | | | DURABILITY TEST EVALUATION | | EVALUATION VALUE | | |
|---|---|---|---|---|---|---|---|
| No. | CONDITION 3 | CONDITION 4 | COLD AND HEAT | IMPACT | T50 (degree) | PRESSURE LOSS (Pa) | REMARKS |
| 149 | A | B | B | B | 310.4 | 58 | INVENTION EXAMPLE 119 |
| 150 | A | B | B | B | 302.1 | 102 | INVENTION EXAMPLE 120 |
| 151 | A | B | B | B | 297.5 | 144 | INVENTION EXAMPLE 121 |

TABLE 5-continued

| | | | | | | | |
|---|---|---|---|---|---|---|---|
| 152 | A | B | B | B | 293 | 227 | INVENTION EXAMPLE 122 |
| 153 | A | B | B | B | 307.1 | 58 | INVENTION EXAMPLE 123 |
| 154 | A | B | B | B | 298.8 | 102 | INVENTION EXAMPLE 124 |
| 155 | A | B | B | B | 294.1 | 144 | INVENTION EXAMPLE 125 |
| 156 | A | B | B | B | 289.7 | 227 | INVENTION EXAMPLE 126 |
| 157 | A | B | B | B | 305.7 | 58 | INVENTION EXAMPLE 127 |
| 158 | A | B | B | B | 297.4 | 101 | INVENTION EXAMPLE 128 |
| 159 | A | B | B | B | 292.9 | 144 | INVENTION EXAMPLE 129 |
| 160 | A | B | B | B | 289.1 | 227 | INVENTION EXAMPLE 130 |
| 161 | A | B | B | B | 306.9 | 58 | INVENTION EXAMPLE 131 |
| 162 | A | B | B | B | 298.4 | 105 | INVENTION EXAMPLE 132 |
| 163 | A | B | B | B | 284.1 | 147 | INVENTION EXAMPLE 133 |
| 164 | A | B | B | B | 290.1 | 234 | INVENTION EXAMPLE 134 |
| 165 | A | B | B | B | 309.7 | 65 | INVENTION EXAMPLE 135 |
| 166 | A | B | B | B | 300.1 | 114 | INVENTION EXAMPLE 136 |
| 167 | A | B | B | B | 296.8 | 155 | INVENTION EXAMPLE 137 |
| 168 | A | B | B | B | 292.3 | 254 | INVENTION EXAMPLE 138 |
| 169 | A | B | B | B | 309.9 | 59 | INVENTION EXAMPLE 139 |
| 170 | A | B | B | B | 301.6 | 103 | INVENTION EXAMPLE 140 |
| 171 | A | B | B | B | 297.1 | 145 | INVENTION EXAMPLE 141 |
| 172 | A | B | B | B | 292.4 | 228 | INVENTION EXAMPLE 142 |
| 173 | A | B | B | B | 306.7 | 59 | INVENTION EXAMPLE 143 |
| 174 | A | B | B | B | 298.2 | 103 | INVENTION EXAMPLE 144 |
| 175 | A | B | B | B | 293.6 | 145 | INVENTION EXAMPLE 145 |
| 176 | A | B | B | B | 289.3 | 228 | INVENTION EXAMPLE 146 |
| 177 | A | B | B | B | 305.2 | 59 | INVENTION EXAMPLE 147 |
| 178 | A | B | B | B | 296.9 | 102 | INVENTION EXAMPLE 148 |
| 179 | A | B | B | B | 282.3 | 145 | INVENTION EXAMPLE 149 |
| 180 | A | B | B | B | 288.6 | 228 | INVENTION EXAMPLE 150 |
| 181 | A | B | B | B | 306.3 | 60 | INVENTION EXAMPLE 151 |
| 182 | A | B | B | B | 297.9 | 107 | INVENTION EXAMPLE 152 |
| 183 | A | B | B | B | 293.6 | 149 | INVENTION EXAMPLE 153 |
| 184 | A | B | B | B | 289.6 | 236 | INVENTION EXAMPLE 154 |
| 185 | A | B | B | B | 309.4 | 67 | INVENTION EXAMPLE 155 |
| 186 | A | B | B | B | 299.7 | 116 | INVENTION EXAMPLE 156 |
| 187 | A | B | B | B | 296.3 | 157 | INVENTION EXAMPLE 157 |
| 188 | A | B | B | B | 291.8 | 256 | INVENTION EXAMPLE 158 |

TABLE 6

| | IMPACT MITIGATING STRUCTURE | | | | | | | | | | | | | |
|---|---|---|---|---|---|---|---|---|---|---|---|---|---|---|
| | BRAZING SECTION | | | | | | NON-BRAZING SECTION | | | | | | | |
| No. | H (mm) | O (mm) | H/O | α (degree) | S1/S2 | I (mm) | H (mm) | O (mm) | H/O | α (degree) | S1/S2 | I (mm) | CONDITION 1 | CONDITION 2 |
| 189 | 2.00 | 2.00 | 1 | 10 | 5 | 3 | 2.00 | 2.00 | 1 | 10 | 0 | — | B | B |
| 190 | 1.50 | 1.50 | 1 | 10 | 5 | 2.5 | 1.50 | 1.50 | 1 | 10 | 0 | — | B | B |
| 191 | 1.25 | 1.25 | 1 | 10 | 5 | 2 | 1.25 | 1.25 | 1 | 10 | 0 | — | B | B |
| 192 | 1.00 | 1.00 | 1 | 10 | 5 | 1 | 1.00 | 1.00 | 1 | 10 | 0 | — | B | B |
| 193 | 1.79 | 2.24 | 0.8 | 10 | 5 | 3 | 1.79 | 2.24 | 0.8 | 10 | 0 | — | B | B |
| 194 | 1.34 | 1.68 | 0.8 | 10 | 5 | 2.5 | 1.34 | 1.68 | 0.8 | 10 | 0 | — | B | B |
| 195 | 1.12 | 1.40 | 0.8 | 10 | 5 | 2 | 1.12 | 1.40 | 0.8 | 10 | 0 | — | B | B |
| 196 | 0.89 | 1.12 | 0.8 | 10 | 5 | 1 | 0.89 | 1.12 | 0.8 | 10 | 0 | — | B | B |
| 197 | 1.26 | 3.16 | 0.4 | 10 | 5 | 3 | 1.26 | 3.15 | 0.4 | 10 | 0 | — | B | B |
| 198 | 0.95 | 2.37 | 0.4 | 10 | 5 | 2.5 | 0.95 | 2.37 | 0.4 | 10 | 0 | — | B | B |
| 199 | 0.79 | 1.98 | 0.4 | 10 | 5 | 2 | 0.79 | 1.98 | 0.4 | 10 | 0 | — | B | B |
| 200 | 0.63 | 1.58 | 0.4 | 10 | 5 | 1 | 0.63 | 1.58 | 0.4 | 10 | 0 | — | B | B |
| 201 | 0.77 | 5.16 | 0.15 | 10 | 5 | 3 | 0.77 | 5.16 | 0.15 | 10 | 0 | — | B | B |
| 202 | 0.58 | 3.87 | 0.15 | 10 | 5 | 2.5 | 0.58 | 3.87 | 0.15 | 10 | 0 | — | B | B |
| 203 | 0.48 | 3.23 | 0.15 | 10 | 5 | 2 | 0.48 | 3.23 | 0.15 | 10 | 0 | — | B | B |
| 204 | 0.39 | 2.58 | 0.15 | 10 | 5 | 1 | 0.39 | 2.58 | 0.15 | 10 | 0 | — | B | B |
| 205 | 0.63 | 6.32 | 0.1 | 10 | 5 | 3 | 0.63 | 6.32 | 0.1 | 10 | 0 | — | B | B |
| 206 | 0.47 | 4.74 | 0.1 | 10 | 5 | 2.5 | 0.47 | 4.74 | 0.1 | 10 | 0 | — | B | B |
| 207 | 0.40 | 3.95 | 0.1 | 10 | 5 | 2 | 0.40 | 3.95 | 0.1 | 10 | 0 | — | B | B |
| 208 | 0.32 | 3.16 | 0.1 | 10 | 5 | 1 | 0.32 | 3.16 | 0.1 | 10 | 0 | — | B | B |
| 209 | 2.00 | 2.00 | 1 | 10 | 5 | 3 | 2.00 | 2.00 | 1 | 10 | 5 | 3 | B | B |
| 210 | 1.50 | 1.50 | 1 | 10 | 5 | 2.5 | 1.50 | 1.50 | 1 | 10 | 5 | 2.5 | B | B |
| 211 | 1.25 | 1.25 | 1 | 10 | 5 | 2 | 1.25 | 1.25 | 1 | 10 | 5 | 2 | B | B |
| 212 | 1.00 | 1.00 | 1 | 10 | 5 | 1 | 1.00 | 1.00 | 1 | 10 | 5 | 1 | B | B |
| 213 | 1.79 | 2.24 | 0.8 | 10 | 5 | 3 | 1.79 | 2.24 | 0.8 | 10 | 5 | 3 | B | B |
| 214 | 1.34 | 1.68 | 0.8 | 10 | 5 | 2.5 | 1.34 | 1.68 | 0.8 | 10 | 5 | 2.5 | B | B |
| 215 | 1.12 | 1.40 | 0.8 | 10 | 5 | 2 | 1.12 | 1.40 | 0.8 | 10 | 5 | 2 | B | B |
| 216 | 0.89 | 1.12 | 0.8 | 10 | 5 | 1 | 0.89 | 1.12 | 0.8 | 10 | 5 | 1 | B | B |
| 217 | 1.26 | 3.16 | 0.4 | 10 | 5 | 3 | 1.26 | 3.16 | 0.4 | 10 | 5 | 3 | B | B |
| 218 | 0.95 | 2.37 | 0.4 | 10 | 5 | 2.5 | 0.95 | 2.37 | 0.4 | 10 | 5 | 2.5 | B | B |
| 219 | 0.79 | 1.98 | 0.4 | 10 | 5 | 2 | 0.79 | 1.95 | 0.4 | 10 | 5 | 2 | B | B |
| 220 | 0.63 | 1.58 | 0.4 | 10 | 5 | 1 | 0.63 | 1.58 | 0.4 | 10 | 5 | 1 | B | B |
| 221 | 0.77 | 5.16 | 0.15 | 10 | 5 | 3 | 0.77 | 5.16 | 0.15 | 10 | 5 | 3 | B | B |
| 222 | 0.58 | 3.87 | 0.15 | 10 | 5 | 2.5 | 0.58 | 3.87 | 0.15 | 10 | 5 | 2.5 | B | B |
| 223 | 0.48 | 3.23 | 0.15 | 10 | 5 | 2 | 0.48 | 3.23 | 0.15 | 10 | 5 | 2 | B | B |
| 224 | 0.39 | 2.58 | 0.15 | 10 | 5 | 1 | 0.39 | 2.58 | 0.15 | 10 | 5 | 1 | B | B |
| 225 | 0.63 | 6.32 | 0.1 | 10 | 5 | 3 | 0.63 | 6.32 | 0.1 | 10 | 5 | 3 | B | B |
| 226 | 0.47 | 4.74 | 0.1 | 10 | 5 | 2.5 | 0.47 | 4.74 | 0.1 | 10 | 5 | 2.5 | B | B |
| 227 | 0.40 | 3.95 | 0.1 | 10 | 5 | 2 | 0.40 | 3.95 | 0.1 | 10 | 5 | 2 | B | B |
| 228 | 0.32 | 3.16 | 0.1 | 10 | 5 | 1 | 0.32 | 3.16 | 0.1 | 10 | 5 | 1 | B | B |

| | | | DURABILITY TEST EVALUATION | | EVALUATION VALUE | | |
|---|---|---|---|---|---|---|---|
| No. | CONDITION 3 | CONDITION 4 | COLD AND HEAT | IMPACT | T50 (degree) | PRESSURE LOSS (Pa) | REMARKS |
| 189 | A | B | B | B | 311.9 | 48 | INVENTION EXAMPLE 159 |
| 190 | A | B | B | B | 304.2 | 81 | INVENTION EXAMPLE 160 |
| 191 | A | B | B | B | 299.1 | 115 | INVENTION EXAMPLE 161 |
| 192 | A | B | B | B | 294.9 | 183 | INVENTION EXAMPLE 162 |
| 193 | A | B | B | B | 308 | 46 | INVENTION EXAMPLE 163 |
| 194 | A | B | B | B | 299.5 | 82 | INVENTION EXAMPLE 164 |
| 195 | A | B | B | B | 295 | 115 | INVENTION EXAMPLE 165 |
| 196 | A | B | B | B | 291.6 | 184 | INVENTION EXAMPLE 166 |
| 197 | A | B | B | B | 306.9 | 47 | INVENTION EXAMPLE 167 |
| 198 | A | B | B | B | 298.7 | 83 | INVENTION EXAMPLE 168 |
| 199 | A | B | B | B | 294.1 | 116 | INVENTION EXAMPLE 169 |

TABLE 6-continued

| | | | | | | | |
|---|---|---|---|---|---|---|---|
| 200 | A | B | B | B | 290.5 | 184 | INVENTION EXAMPLE 170 |
| 201 | A | B | B | B | 308 | 47 | INVENTION EXAMPLE 171 |
| 202 | A | B | B | B | 299.3 | 83 | INVENTION EXAMPLE 172 |
| 203 | A | B | B | B | 295.1 | 117 | INVENTION EXAMPLE 173 |
| 204 | A | B | B | B | 291.4 | 185 | INVENTION EXAMPLE 174 |
| 205 | A | B | B | B | 311.5 | 48 | INVENTION EXAMPLE 175 |
| 206 | A | B | B | B | 303.4 | 84 | INVENTION EXAMPLE 176 |
| 207 | A | B | B | B | 298.1 | 118 | INVENTION EXAMPLE 177 |
| 208 | A | B | B | B | 294.1 | 186 | INVENTION EXAMPLE 178 |
| 209 | A | B | B | B | 311.5 | 47 | INVENTION EXAMPLE 179 |
| 210 | A | B | B | B | 303.7 | 82 | INVENTION EXAMPLE 180 |
| 211 | A | B | B | B | 298.6 | 116 | INVENTION EXAMPLE 181 |
| 212 | A | B | B | B | 294.5 | 184 | INVENTION EXAMPLE 182 |
| 213 | A | B | B | B | 307.5 | 47 | INVENTION EXAMPLE 183 |
| 214 | A | B | B | B | 299.1 | 83 | INVENTION EXAMPLE 184 |
| 215 | A | B | B | B | 294.5 | 116 | INVENTION EXAMPLE 185 |
| 216 | A | B | B | B | 291.2 | 185 | INVENTION EXAMPLE 186 |
| 217 | A | B | B | B | 306.4 | 48 | INVENTION EXAMPLE 187 |
| 218 | A | B | B | B | 298.2 | 84 | INVENTION EXAMPLE 188 |
| 219 | A | B | B | B | 293.8 | 117 | INVENTION EXAMPLE 189 |
| 220 | A | B | B | B | 290.1 | 185 | INVENTION EXAMPLE 190 |
| 221 | A | B | B | B | 307.5 | 48 | INVENTION EXAMPLE 191 |
| 222 | A | B | B | B | 298.8 | 84 | INVENTION EXAMPLE 192 |
| 223 | A | B | B | B | 294.6 | 118 | INVENTION EXAMPLE 193 |
| 224 | A | B | B | B | 290.9 | 186 | INVENTION EXAMPLE 194 |
| 225 | A | B | B | B | 311.1 | 49 | INVENTION EXAMPLE 195 |
| 226 | A | B | B | B | 302.9 | 85 | INVENTION EXAMPLE 196 |
| 227 | A | B | B | B | 297.7 | 119 | INVENTION EXAMPLE 197 |
| 228 | A | B | B | B | 293.7 | 187 | INVENTION EXAMPLE 198 |

Figure 11:
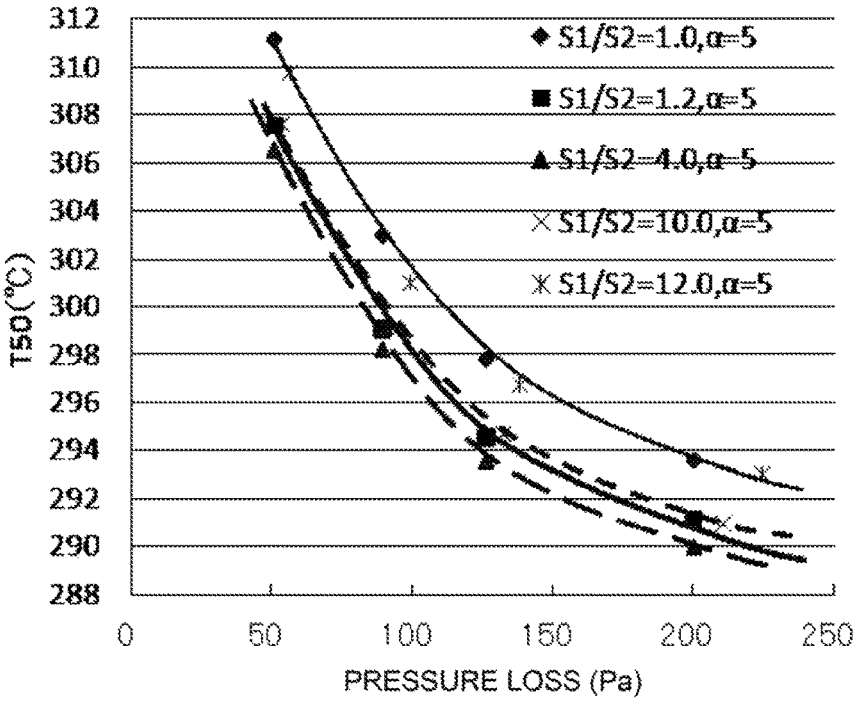
FIG. 11 is a graph of Table 4.
Figure 12:
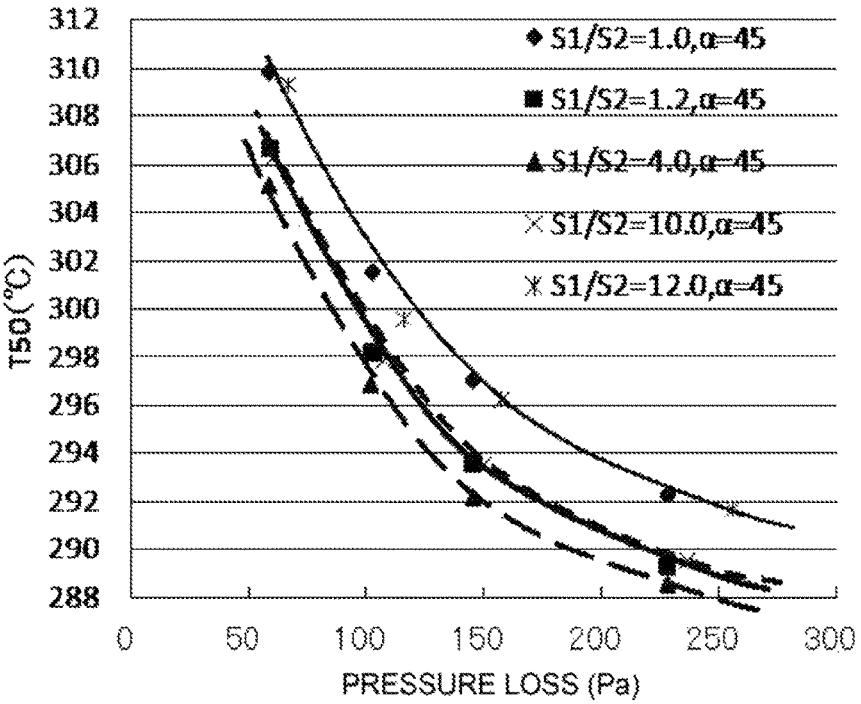
FIG. 12 is a graph of Table 5.
Figure 13:
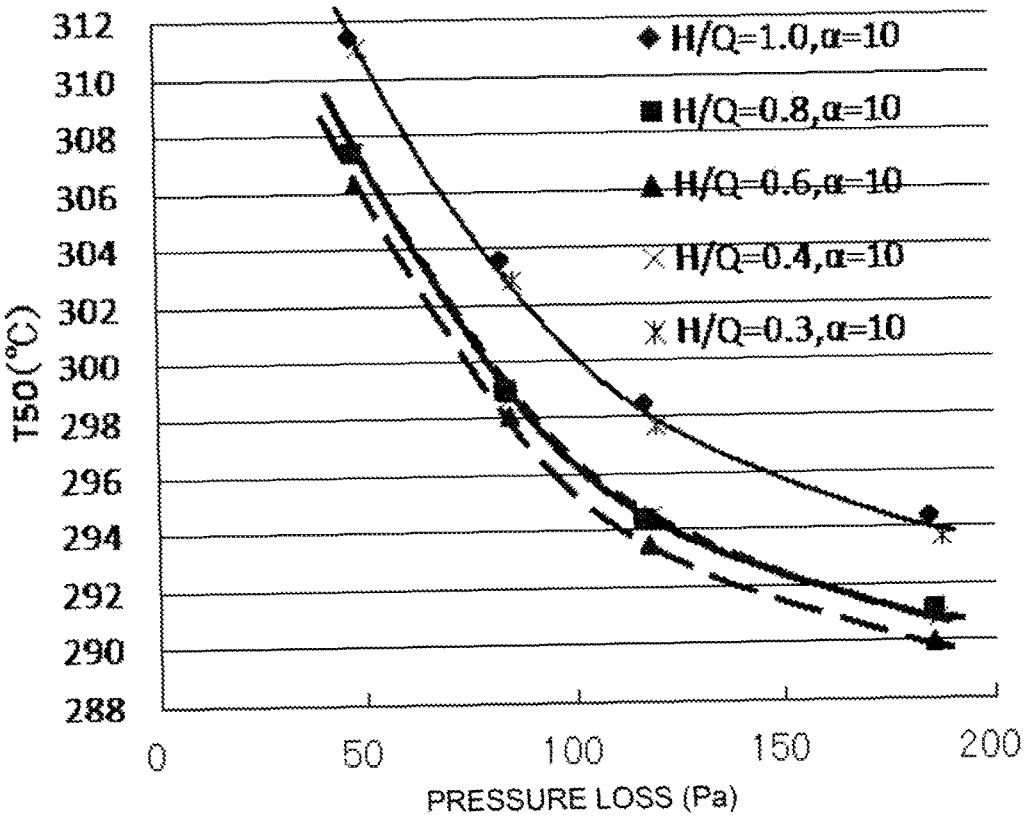
FIG. 13 is a graph of Table 6.

The test result of Table 4 is shown in FIG. 11, the test result of Table 5 is shown in FIG. 12, and the test result of Table 6 is shown in FIG. 13.

The invention claimed is:

1. A metal substrate for catalytic converter, comprising: a honeycomb core containing a flat metal foil and a corrugated metal foil laminated onto each other; and a metal outer jacket surrounding an outer circumferential surface of the honeycomb core, wherein:

the flat metal foil and the corrugated metal foil disposed in a gas inlet side joining section are joined to each other;

the flat metal foil and the corrugated metal foil disposed in an outer circumferential joining section are joined to each other, the outer circumferential joining section is connected to an axial end section of the gas inlet side joining section;

the gas inlet side joining section extends 5 mm or more and 50% or less of an entire length in an axial direction from a gas inlet side end section of the honeycomb core, across all layers in a radial direction of the honeycomb core;

the outer circumferential joining section extends from the axial end section of the gas inlet side joining section toward a gas outlet side end section of the honeycomb core across two or more layers and ⅓ or less of the total number of layers in the radial direction from an outermost circumference of the honeycomb core;

the outer jacket and the honeycomb core are joined by interposing a joining layer in a gas outlet side end section area formed between the outer jacket and the honeycomb core and extending from the gas outlet side end section of the honeycomb core in the axial direction; when the joining layer has a length P in the axial direction, P fulfills the following formula (A);

the catalytic converter is capable of purifying exhaust gas emitted from a vehicle;

the corrugated metal foil has an impact mitigating section having different wave phases between a front and rear in the axial direction; and the impact mitigating section is formed in a region corresponding to at least the gas inlet side joining section and the outer circumferential joining section;

and the impact mitigating section is configured such that an offset width being an axial length of a wave having the same phase is 50 mm or less and an amount of phase shift between axially neighboring waves is 0.05 mm or more:

$$2\text{ mm} \leq P \leq 50\text{ mm} \quad \text{(A).}$$

2. The metal substrate for catalytic converter according to claim 1, wherein the P fulfills the following formula (B):

$$5\text{ mm} \leq P \leq 45\text{ mm} \quad \text{(B).}$$

3. The metal substrate for catalytic converter according to claim 1, wherein:

the impact mitigating section is formed by connecting continuous bodies, each including trapezoid-like gas channels continuously disposed in an orthogonal plane being orthogonal to the axial direction, in the axial direction with their phases shifted; and when the gas channel is divided into two regions according to a position corresponding to axially neighboring corrugated metal foils in a view in the axial direction, an area of one region is defined as S1, and an area of the other region is defined as S2, the area S1 and the area S2 are different from each other.

4. The metal substrate for catalytic converter according to claim 3, wherein the area S1 and the area S2 fulfill the following condition formula (C):

$$1.2 \leq S1/S2 \leq 10 \quad \text{(C).}$$

5. The metal substrate for catalytic converter according to claim 3, wherein:

the corrugated metal foil includes a pair of tapered sections that constitute side walls of the gas channel; and when Q is a pitch of the gas channel corresponding to a length of a line connecting respective midpoints of the pair of tapered sections, H is a height of the pair of tapered sections, and a is an angle formed between the radial direction and the tapered section, the following condition formula (D) or (E) is fulfilled:

$$0.15 \leq H/Q \leq 0.85 \quad \text{(D), and}$$

$$5° \leq \alpha \leq 45° \quad \text{(E).}$$

6. The metal substrate for catalytic converter according to claim 3, wherein, when L is a length of the trapezoid-like gas channel in the axial direction, the following condition formula (F) is fulfilled:

$$0.1\text{ mm} \leq L \leq 100\text{ mm} \quad \text{(F).}$$

7. The metal substrate for catalytic converter according to claim 2, wherein:

the impact mitigating section is formed by connecting continuous bodies, each including trapezoid-like gas channels continuously disposed in an orthogonal plane being orthogonal to the axial direction, in the axial direction with their phases shifted; and when the gas channel is divided into two regions according to a position corresponding to axially neighboring corrugated metal foils in a view in the axial direction, an area of one region is defined as S1, and an area of the other region is defined as S2, the area S1 and the area S2 are different from each other.

8. The metal substrate for catalytic converter according to claim 7, wherein the area S1 and the area S2 fulfill the following condition formula (C):

$$1.2 \leq S1/S2 \leq 10 \quad \text{(C).}$$

9. The metal substrate for catalytic converter according to claim 4, wherein:

the corrugated metal foil includes a pair of tapered sections that constitute side walls of the gas channel; and when Q is a pitch of the gas channel corresponding to a length of a line connecting respective midpoints of the pair of tapered sections, H is a height of the pair of tapered sections, and a is an angle formed between the radial direction and the tapered section, the following condition formula (D) or (E) is fulfilled:

$$0.15 \leq H/Q \leq 0.85 \quad \text{(D), and}$$

$$5° \leq \alpha \leq 45° \quad \text{(E).}$$

10. The metal substrate for catalytic converter according to claim 7, wherein:

the corrugated metal foil includes a pair of tapered sections that constitute side walls of the gas channel; and when Q is a pitch of the gas channel corresponding to a length of a line connecting respective midpoints of the pair of tapered sections, H is a height of the pair of tapered sections, and a is an angle formed between the radial direction and the tapered section, the following condition formula (D) or (E) is fulfilled:

$$0.15 \leq H/Q \leq 0.85 \quad \text{(D), and}$$

$$5° \leq \alpha \leq 45° \quad \text{(E).}$$

11. The metal substrate for catalytic converter according to claim 8, wherein:

the corrugated metal foil includes a pair of tapered sections that constitute side walls of the gas channel; and when Q is a pitch of the gas channel corresponding to a length of a line connecting respective midpoints of the pair of tapered sections, H is a height of the pair of tapered sections, and a is an angle formed between the radial direction and the tapered section, the following condition formula (D) or (E) is fulfilled:

$$0.15 \leq H/Q \leq 0.85 \quad \text{(D), and}$$

$$5° \leq \alpha \leq 45° \quad \text{(E).}$$

12. The metal substrate for catalytic converter according to claim 4, wherein, when L is a length of the trapezoid-like gas channel in the axial direction, the following condition formula (F) is fulfilled:

$$0.1\text{ mm} \leq L \leq 100\text{ mm} \quad \text{(F).}$$

13. The metal substrate for catalytic converter according to claim 5, wherein, when L is a length of the trapezoid-like gas channel in the axial direction, the following condition formula (F) is fulfilled:

$$0.1\text{ mm} \leq L \leq 100\text{ mm} \quad \text{(F).}$$

14. The metal substrate for catalytic converter according to claim 7, wherein, when L is a length of the trapezoid-like gas channel in the axial direction, the following condition formula (F) is fulfilled:

$$0.1\ \text{mm} \leq L \leq 100\ \text{mm} \quad \text{(F).}$$

15. The metal substrate for catalytic converter according to claim 8, wherein, when L is a length of the trapezoid-like gas channel in the axial direction, the following condition formula (F) is fulfilled:

$$0.1\ \text{mm} \leq L \leq 100\ \text{mm} \quad \text{(F).}$$

16. The metal substrate for catalytic converter according to claim 9, wherein, when L is a length of the trapezoid-like gas channel in the axial direction, the following condition formula (F) is fulfilled:

$$0.1\ \text{mm} \leq L \leq 100\ \text{mm} \quad \text{(F).}$$

17. The metal substrate for catalytic converter according to claim 10, wherein, when L is a length of the trapezoid-like gas channel in the axial direction, the following condition formula (F) is fulfilled:

$$0.1\ \text{mm} \leq L \leq 100\ \text{mm} \quad \text{(F).}$$

18. The metal substrate for catalytic converter according to claim 11, wherein, when L is a length of the trapezoid-like gas channel in the axial direction, the following condition formula (F) is fulfilled:

$$0.1\ \text{mm} \leq L \leq 100\ \text{mm} \quad \text{(F).}$$

* * * * *